US009077082B2

(12) United States Patent
Tatarnikov et al.

(10) Patent No.: US 9,077,082 B2
(45) Date of Patent: Jul. 7, 2015

(54) PATCH ANTENNA WITH CAPACITIVE RADIATING PATCH

(75) Inventors: Dmitry V. Tatarnikov, Moscow (RU); Andrey V. Astakhov, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 892 days.

(21) Appl. No.: 13/190,620

(22) Filed: Jul. 26, 2011

(65) Prior Publication Data

US 2012/0056787 A1 Mar. 8, 2012

Related U.S. Application Data

(60) Provisional application No. 61/379,450, filed on Sep. 2, 2010.

(51) Int. Cl.
*H01Q 9/04* (2006.01)
*H01Q 21/06* (2006.01)

(52) U.S. Cl.
CPC ..... *H01Q 21/065* (2013.01); *H01Q 9/0421* (2013.01); *H01Q 9/0428* (2013.01); *H01Q 9/0442* (2013.01); *H01Q 9/0457* (2013.01)

(58) Field of Classification Search
CPC ..... H01Q 3/26; H01Q 3/2652; H01Q 3/2682; H01Q 9/0407; H01Q 9/0414; H01Q 9/0421; H01Q 9/045; H01Q 19/005; H01Q 21/0031; H01Q 21/065; H01Q 21/08; H01Q 21/10
See application file for complete search history.

(56) References Cited

U.S. PATENT DOCUMENTS 4,434,425 A * 2/1984 Barbano ..... 343/797
4,710,775 A * 12/1987 Coe ..... 343/727
5,005,019 A * 4/1991 Zaghloul et al. ..... 343/700 MS (Continued)

FOREIGN PATENT DOCUMENTS

WO WO 2005050774 6/2005
WO WO 2008078284 7/2008

OTHER PUBLICATIONS

John L. Volakis, Antenna Engineering Handbook, 2007, McGraw Hill, 4th ed, p. 8-2.*
Partial PCT International Search Report corresponding to PCT Application No. PCT/IB2011/001877 filed Aug. 12, 2011 (8 pages).
PCT International Search Report, dated Jan. 31, 2012, corresponding to PCT Application No. PCT/IB2011/001877 filed Aug. 12, 2011 (12 pages).

(Continued)

*Primary Examiner* — Hoang V Nguyen
*Assistant Examiner* — Patrick Holecek
(74) *Attorney, Agent, or Firm* — Chiesa Shahinian & Giantomasi PC

(57) ABSTRACT

A patch antenna includes a capacitive radiating patch, a ground plane, and vertical coupling elements electrically connected to defined portions of the capacitive radiating patch and the ground plane. The capacitive radiating patch includes an array of conductive segments along the periphery and within the interior of the capacitive radiating patch. Capacitors are electrically connected to specific conductive segments in a defined pattern. Vertical coupling elements electrically connect specific conductive segments along the periphery of the capacitive radiating patch to the ground plane. Vertical coupling elements can be conductors or defined combinations of resistors, inductors, and capacitors. Various embodiments of the patch antenna are configured for linear polarization and circular polarization. Relative to a conventional patch antenna of a similar size, a patch antenna with a capacitive radiating patch has a broader operational bandwidth and a broader radiation pattern in the forward hemisphere.

34 Claims, 23 Drawing Sheets

(56) References Cited

U.S. PATENT DOCUMENTS

| | | | | |
|---|---|---|---|---|
| 5,598,168 | A * | 1/1997 | Evans et al. | 343/700 MS |
| 5,818,391 | A * | 10/1998 | Lee | 343/700 MS |
| 6,160,522 | A | 12/2000 | Sanford | |
| 2004/0113842 | A1 | 6/2004 | du Toit et al. | |
| 2004/0201526 | A1 | 10/2004 | Knowles et al. | |
| 2005/0030246 | A1 * | 2/2005 | Durham et al. | 343/795 |
| 2006/0164309 | A1 | 7/2006 | Fujishima et al. | |

OTHER PUBLICATIONS

Written Opinion of the International Searching Authority, dated Jan. 31, 2012, corresponding to PCT Application No. PCT/IB2011/001877 filed on Aug. 12, 2011 (11 pages).

* cited by examiner

FIG. 1
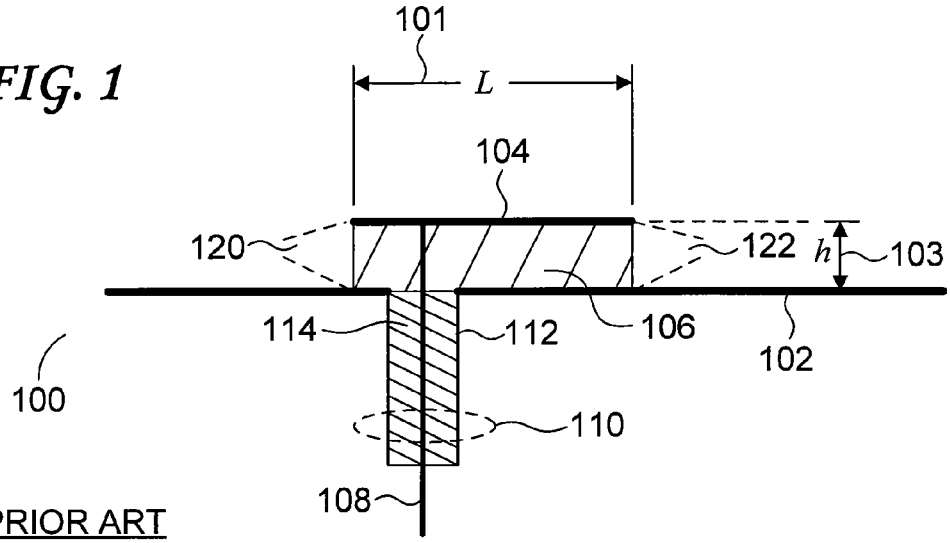
PRIOR ART
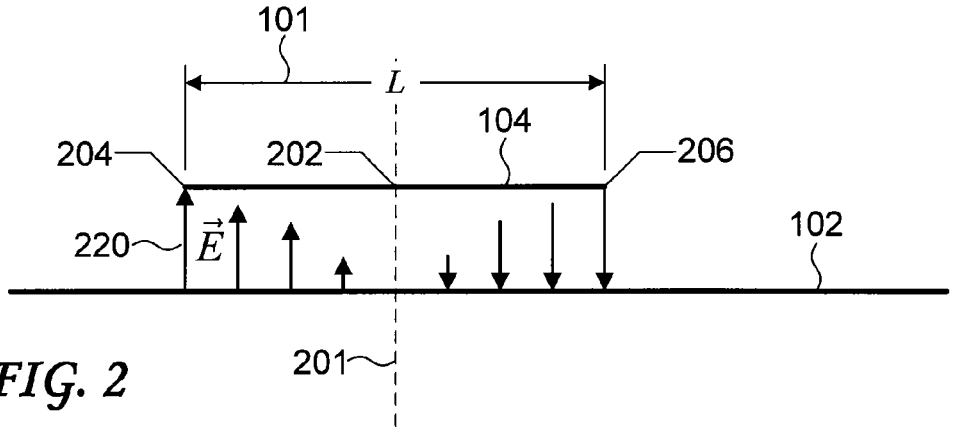
FIG. 2
PRIOR ART

VIEW C
502
532
504
y
z

VIEW A
520
560-1
560-2
560-3
560-4
560-5
560-6
560-7
540-(1,1)
540-(1,7)
540-(6,1)
540-(6,7)
502
504
500
552-1
552-2
550-1
550-2
550-3
550-4
550-5
550-6
x
X
X'
y
E

VIEW B
532
502
504
530
580
z
x 502
632-1
680
632-6
y
z
604
VIEW C 620
y
$\vec{E}$
660-1
664-1
664-6
662-1
670-(1,6)
640-(1,7)
632-1
502
x
640-(6,7)
632-6
670-(6,6)
662-8
666-6
666-1
640-(1,1)
630-1
670-(1,1)
VIEW A
604
640-(6,1)
630-6
670-(6,1)
660-8
600 x
632-6
502
z
680
604
630-6
VIEW B y
502
732-1
742
732-6
z
604
VIEW C 720
y
$\vec{E}$
660-1
664-1
662-1
664-6
670-(1,6)
640-(1,7)
732-1
502
x
640-(6,7)
732-6
670-(6,6)
742
662-8
666-6
666-1
660-8
640-(1,1)
730-1
670-(1,1)
VIEW A
604
640-(6,1)
730-6
670-(6,1)
740
700 x
732-6
502
742
680
740
z
604
730-6
VIEW B

VIEW C
502
852-1
742
852-6
832-6
832-1
604
y
z

VIEW A
820
$\vec{E}$
y
x
X
X'
670-(1,6)
640-(1,7)
832-1
502
640-(6,7)
832-6
670-(6,6)
742
662-8
662-1
664-6
666-6
664-1
666-1
660-1
660-8
640-(1,1)
830-1
670-(1,1)
604
640-(6,1)
830-6
670-(6,1)
740
800

VIEW B
852-6
832-6
502
742
680
740
604
850-6
830-6
z
x

VIEW X-X'

VIEW A

VIEW C

VIEW X-X'
1000
1020
1010
1012
1030
1032
1040
1042
1050
1052
1062-1
1062-6
1072-1
1072-6
502
604
640-(1,1)
640-(1,7)
640-(6,1)
640-(6,7)
660-1
660-8
662-1
662-8
664-1
664-6
666-1
666-6
670-(1,1)
670-(1,6)
670-(6,1)
670-(6,6)
680
740
742
X
X'
x
y
z
$\vec{E}$

VIEW A

VIEW B

VIEW C
502
1130-6
632-1
680
632-6
1132-6
1104
1140-(1,6)
662-1
670-(1,6)
640-(1,7)
640-(6,7)
670-(6,6)
662-8
1140-(7,6)
1130-6
664-6
666-6
1132-6
1140-(7,1)
1130-1
664-1
1140-(1,1)
660-1
640-(1,1)
630-1
670-(1,1)
640-(6,1)
630-6
670-(6,1)
660-8
666-1
1132-1
1100
630-6
1132-1

VIEW A

VIEW B

VIEW X-X'

VIEW A

VIEW X-X'

VIEW Y-Y'

VIEW B

VIEW C

VIEW A
1140-(1,6)
662-1
670-(1,6)
640-(1,7)
502
640-(6,7)
670-(6,6)
662-8
1140-(7,6)
664-6
666-6
664-1
1140-(7,1)
666-1
1140-(1,1)
660-1
640-(1,1)
670-(1,1)
1602
1104
640-(6,1)
670-(6,1)
660-8
1600
X
X'
x
y

VIEW B
1601
d
502
1662-6
1672-6
1644
1642
1662-1
1672-1
1602
z

VIEW C
1692-1
1648
1692-6
1602
502
1682-1
1646
1104
1682-6
z
y

VIEW A
1700
1704
1705
1710
1712
1714
1716
1730-1
1730-4
1730-7
1732-1
1732-4
1732-7
1734-1
1734-4
1734-7
1736-1
1736-4
1736-7
1740-(1,8)
1740-(7,8)
1740-(1,1)
1740-(7,1)
1742-(1,1)
1742-(1,7)
1742-(8,1)
1742-(8,7)
1760-1
1760-7
1762-1
1762-7
1764-1
1764-7
1766-1
1766-7
1770-(1,1)
1770-(1,7)
1770-(7,1)
1770-(7,7)
x
y
X
X'
w

VIEW C
1712
1714
1716
1704
1722
1724
1726
502
1780
1732-1
1732-7
y
z

VIEW X-X'
1701
1703
1704
1710
1714
1720
1724
1780
502
x
z
s
l

VIEW X-X'

PATCH ANTENNA WITH CAPACITIVE RADIATING PATCH

This application claims the benefit of U.S. Provisional Application No. 61/379,450 filed Sep. 2, 2010, which is incorporated herein by reference.

BACKGROUND OF THE INVENTION

The present invention relates generally to antennas, and more particularly to patch antennas.

Design parameters of antennas are determined by the application of interest. Weakly-directional antennas are advantageous for many applications, such as global navigation satellite systems (GNSSs). Well-known examples of GNSSs include the United States Global Positioning System (GPS) and the Russian GLONASS system. Other systems, such as the European Galileo system, are planned. Proprietary systems such as the OmniSTAR differential GPS have also been deployed.

In a GNSS, a navigation receiver tracks radiofrequency signals transmitted by a constellation of satellites. Accuracy in determining the position of the navigation receiver increases as the number of satellites tracked by the navigation receiver increases. The receiving antenna, therefore, should have a uniform radiation pattern in the forward hemisphere.

The number of satellites tracked by a navigation receiver can also be increased if the navigation receiver is capable of tracking signals from more than one GNSS. A multi-system navigation receiver, for example, can track signals from GPS, GLONASS, and Galileo satellites. For multi-system operation, a receiving antenna with a wide bandwidth is needed.

Many GNSS applications require mobile receivers that are compact and lightweight. Since the receiving antenna is typically integrated with the navigation receiver, the receiving antenna also needs to be compact and lightweight.

Antennas with compact size, light weight, uniform radiation pattern in the forward hemisphere, and wide bandwidth are therefore desirable.

BRIEF SUMMARY OF THE INVENTION

A patch antenna includes a capacitive radiating patch, a ground plane separated from the capacitive radiating patch by a dielectric medium, and vertical coupling elements electrically connected to defined portions of the capacitive radiating patch and the ground plane. The dielectric medium can be air or a dielectric solid. The capacitive radiating patch includes an array of conductive segments along the periphery and within the interior of the capacitive radiating patch. In some embodiments, the array of conductive segments is configured as an array of conductive strips.

Capacitors are electrically connected to specific conductive segments in a defined pattern. Vertical coupling elements electrically connect specific conductive segments along the periphery of the capacitive radiating patch to the ground plane. Vertical coupling elements can be conductors or defined combinations of resistors, inductors, and capacitors. Various embodiments of the patch antenna are configured for linear polarization and circular polarization. Various embodiments of the patch antenna include a secondary ground plane to reduce multipath reception. Various embodiments of the patch antenna include integrated feed patches that can be coupled to excitation sources.

Relative to a conventional patch antenna of a similar size, a patch antenna with a capacitive radiating patch has a broader operational bandwidth and a broader radiation pattern in the forward hemisphere.

These and other advantages of the invention will be apparent to those of ordinary skill in the art by reference to the following detailed description and the accompanying drawings.

BRIEF DESCRIPTION OF THE DRAWINGS

FIG. 1 shows a schematic of a prior-art patch antenna;

FIG. 2 shows the electric field distribution for a prior-art patch antenna;

DETAILED DESCRIPTION

Figure 3A:
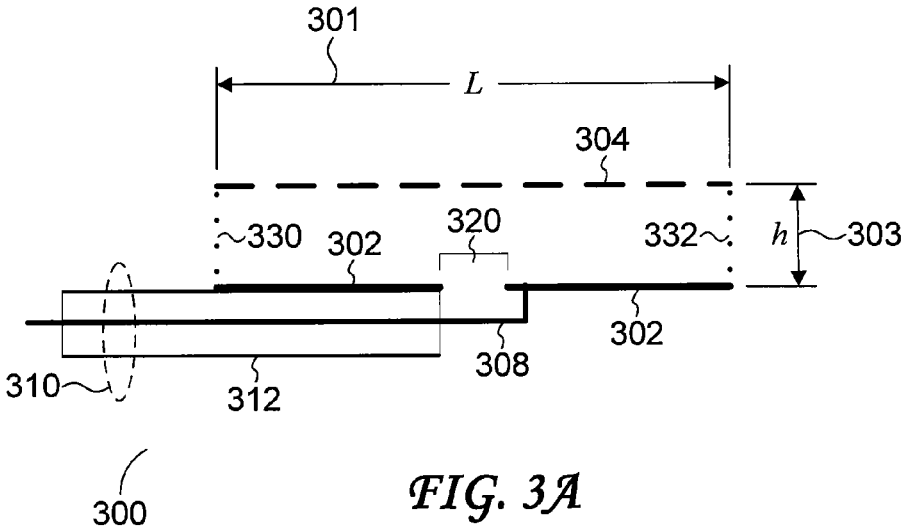
FIG. 3A and FIG. 3B show schematics of a patch antenna with a capacitive radiating patch.

Although the examples of applications described herein focus primarily on antennas in the receiving mode, some examples, as well as modelling, describe antennas in the transmitting mode. From the well-known antenna reciprocity theorem, operational characteristics of an antenna in the receiving mode correspond to operational characteristics in the transmitting mode.

For navigation receivers, patch antennas are commonly used. FIG. 1 shows a cross-sectional schematic of a prior-art patch antenna 100. The patch antenna 100 is a resonator formed by a ground plane 102 and a radiating patch 104. The radiating patch 104 is parallel to the ground plane 102. The space between the ground plane 102 and the radiating patch 104 is filled with a dielectric medium 106. The dielectric medium can be air or a solid dielectric. Electromagnetic signals are fed to the radiating patch 104 via a probe 108. The probe 108 can be the center conductor of a coaxial cable 110, whose shield 112 is electrically connected to the ground plane 102. An insulator 114 dielectrically isolates the probe 108 from the shield 112; the insulator 114 can also be air or a solid dielectric. The radiating patch 104 has a lateral dimension L 101. The distance (height) between the radiating patch 104 and the ground plane 102 is denoted h 103. The resonator is placed under load; the radiation admittance is determined by a radiating slot 120 and a radiating slot 122 formed by the ground plane 102 and the ends of the radiating patch 104. Each radiating slot has a width equal to h 103.

FIG. 2 shows the orientation of the electric field (E-field) vector $\vec{E}$ and the electric field distribution along the patch antenna 100. To simplify the drawing, the coaxial cable 110 is not shown. The electric field vectors 220 are orthogonal to the plane of the ground plane 102 and the plane of the radiating patch 104. Shown for reference is the center axis 201, which is orthogonal to the radiating patch 104 and passes through the center of the radiating patch 104. The electric field magnitude is equal to zero at the center (denoted center 202) and maximal at the edges (denoted edge 204 and edge 206) of the radiating patch 104. If the size of the radiating patch 104 approaches $$L = \frac{\lambda_0}{2},$$

the distance between the radiating slots is approximately $$\frac{\lambda_0}{2}$$

as well, where $\lambda_0$ is the wavelength of the electromagnetic radiation in free space.

It is well known that the radiation field of a slot on a ground plane can be described by an equivalent magnetic current. In a two-dimensional approximation, the radiation pattern of a standard patch antenna in the forward hemisphere can be represented as the field of two in-phase filamentary magnetic currents, separated by the distance L, on an infinite ground plane. The normalized radiation pattern of the patch antenna in the forward hemisphere is then described by a function:

$$F_1(\theta) = \cos\left(k_0 \frac{L}{2} \cos(\theta)\right), \tag{E1}$$

where $$k_0 = \frac{2\pi}{\lambda_0},$$

and θ is the elevation angle measured from the ground plane 102. For $$L = \frac{\lambda_0}{2},$$

the radiation pattern near the horizon (θ=0) becomes zero:

$$F_1\left(\theta = 0,\ L = \frac{\lambda_0}{2}\right) = 0. \tag{E2}$$

To expand the radiation pattern, the size of the radiating patch, L, should be reduced; however, the resonance operation mode also should be maintained. To achieve these results, the dielectric medium 106 can be chosen to have a high dielectric permittivity. Alternatively, capacitive elements can be configured near the radiating slots. In either case, however, the reactive power increases; consequently, the quality factor (Q-factor) increases and the operational bandwidth decreases.

FIG. 3A shows a cross-sectional schematic of a patch antenna 300 according to an embodiment of the invention. The patch antenna 300 includes a ground plane 302 and a capacitive radiating patch 304 parallel to the ground plane 302. In some embodiments, the space between the ground plane 302 and the capacitive radiating patch 304 is filled with air. In other embodiments, the space between the ground plane 302 and the capacitive radiating patch 304 is filled with a dielectric solid. The capacitive radiating patch 304 has a lateral dimension L 301. In some embodiments, $L \approx \lambda_0/2$. In the embodiment shown in FIG. 3A, the ground plane 302 has the same lateral dimension as the capacitive radiating patch 304. In other embodiments, the ground plane 302 is larger than the capacitive radiating patch 304. The distance (height) between the capacitive radiating patch 304 and the ground plane 302 is h 303. In some embodiments, the value of h ranges from $\sim(0.03\text{-}0.1)\lambda_0$. The vertical coupling elements 330 and the vertical coupling elements 332 are configured along the edges of the capacitive radiating patch 304. Further details of vertical coupling elements are discussed below.

The ground plane 302 has a slot 320. The slot 320 is fed by a probe 308, which can be the center conductor of a coaxial cable 310 (to simplify the drawing, the insulator in the coaxial cable is not shown). The shield 312 of the coaxial cable 310 is electrically connected to the ground plane 302. The dimensions and position of the slot 320 and the position of the probe 308 depend on design parameters such as the wave resistance of the power supply line. Other embodiments of feed systems can be used; additional examples are described below.

Figure 3B:
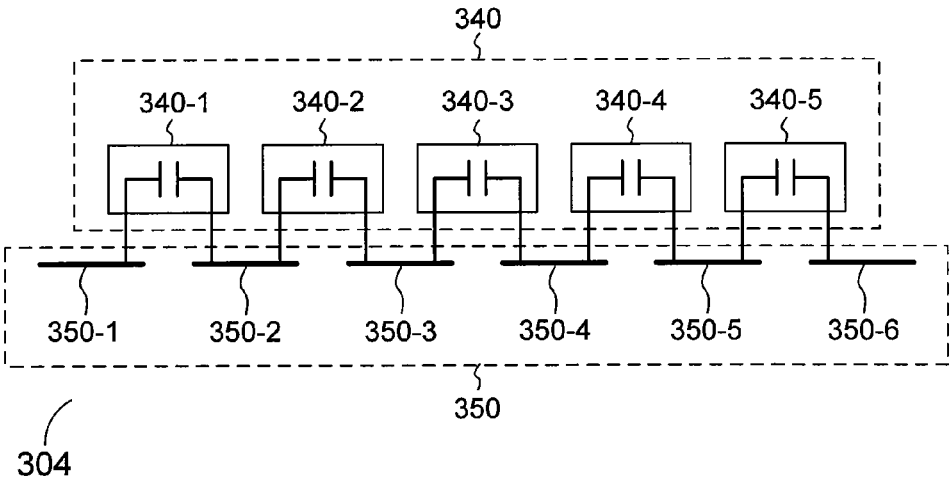

FIG. 3B shows details of the capacitive radiating patch 304. The capacitive radiating patch 304 includes an array of conductive segments 350 and an array of capacitors 340. The array of conductive segments 350 includes six conductive segments, denoted conductive segment 350-1 . . . conductive segment 350-6. The array of capacitors 340 includes five capacitors, denoted capacitor 340-1 . . . capacitor 340-5. The capacitor 340-1 bridges the conductive segment 350-1 and the conductive segment 350-2; the capacitor 340-2 bridges the conductive segment 350-2 and the conductive segment 350-3; the capacitor 340-3 bridges the conductive segment 350-3 and the conductive segment 350-4; the capacitor 340-4 bridges the conductive segment 350-4 and the conductive segment 350-5; and the capacitor 340-5 bridges the conductive segment 350-5 and the conductive segment 350-6. Each capacitor has an associated capacitive impedance.

Figure 4:
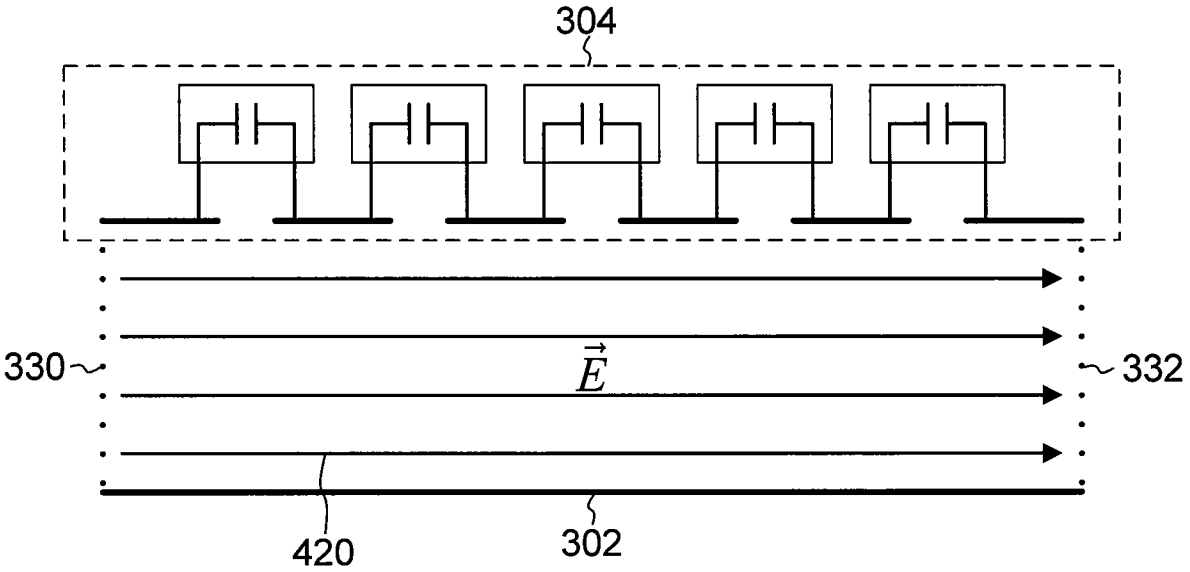
FIG. 4 shows the electric field distribution for a patch antenna with a capacitive radiating patch.

FIG. 4 shows the orientation of the electric field (E-field) vector $\vec{E}$ and the electric field distribution along the patch antenna 300. To simplify the drawing, the coaxial cable 310 is not shown. In contrast to the electric field distribution previously shown in FIG. 2 for the standard patch antenna 100, the electric field vectors 420 are parallel to the plane of the ground plane 302 and the plane of the capacitive radiating patch 304. The electric field vectors 420 have a constant magnitude.

Uniform distribution of the E-field is achieved by selecting specific values of the capacitors in the array of capacitors 340. If the vertical coupling elements 330 and the vertical coupling elements 332 are ideally-conductive surfaces electrically connected to the ground plane 302 and electrically connected to the capacitive radiating patch 304, then the E-field distribution can be numerically calculated. Using a two-dimensional approximation, the integral equation for the E-field is:

$$\int_{-\frac{L}{2}}^{\frac{L}{2}} f(x')(G^{+}(x,x') - G^{-}(x,x'))dx' = \frac{f(x)}{Z(x)} + j^{inc}(x), \tag{E3}$$

where:

- f(x) is the unknown distribution function of the electric field tangent component along the surface of the capacitive radiating patch 304;
- $G^{+}$ (x,x') is the Green's function for the region above the capacitive radiating patch 304;
- $G^{-}$(x,x') is the Green's function for the region between the capacitive radiating patch 304 and the ground plane 302;
- x is the source point;
- x' is the observation point;
- $j^{inc}$ (x) is the electrical current density induced on the capacitive radiating patch 304 by a foreign slot source in the ground plane 302; and
- Z(x) is the impedance distribution along the surface of the capacitive radiating patch 304.

If the impedance Z(x) is uniformly distributed along the capacitive radiating patch 304 and is capacitive [Z(x)=iX, X<0], then it can be shown that there exists a value of the reactive impedance X such that f(x) is approximately constant. It then follows that the radiation pattern for the patch antenna in the forward hemisphere can be represented as the radiation pattern of an in-phase uniform aperture with length L according to the following equation:

$$F_2(\theta) = \frac{\sin\left(k_0 \frac{L}{2}\cos(\theta)\right)}{k_0 \frac{L}{2}\cos(\theta)}. \tag{E4}$$

From (E4), at $$L = \frac{\lambda_0}{2},$$

the level of the radiation pattern near the horizon is not equal to zero, but is given by:

$$F_1\left(\theta = 0, L = \frac{\lambda_0}{2}\right) = \frac{2}{\pi}. \tag{E5}$$

This value is approximately −4 dB relative to the maximum of the radiation pattern.

Figure 5A:
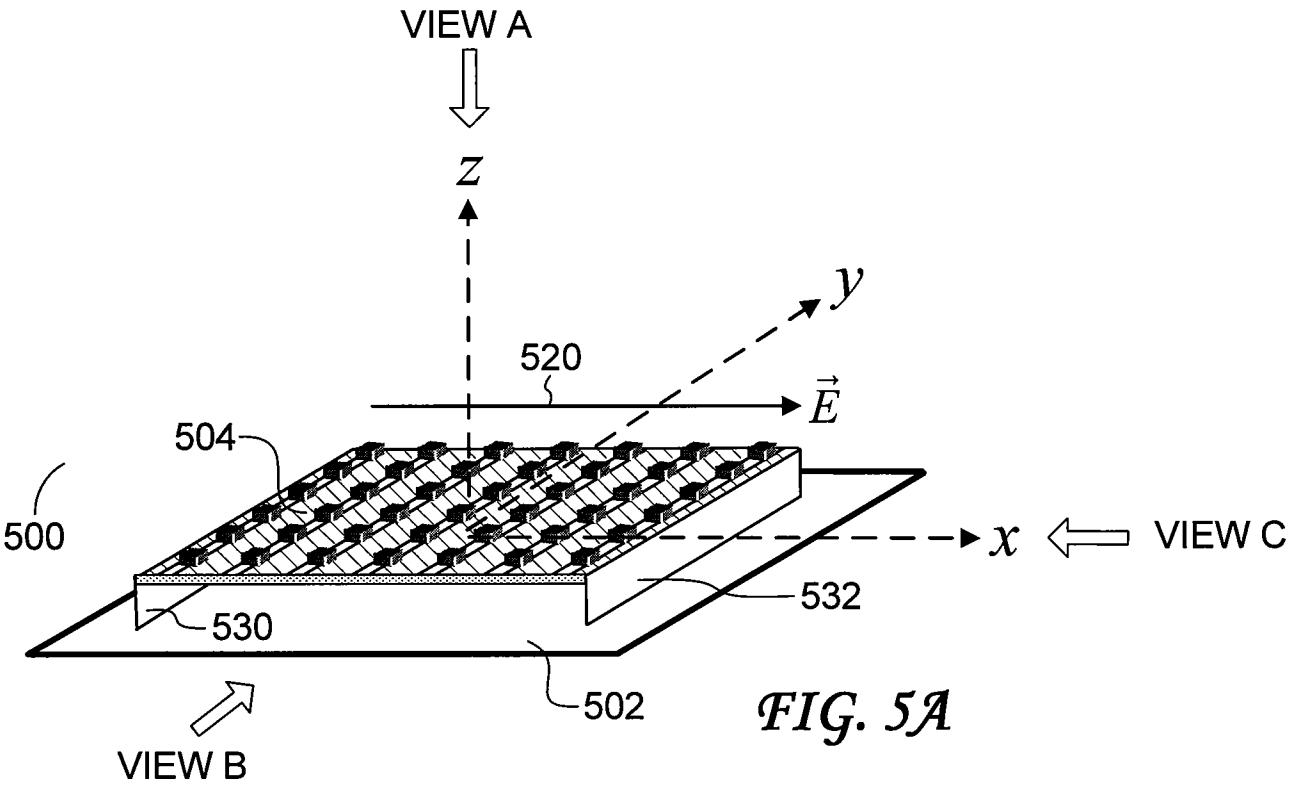
FIG. 5A-FIG. 5D show an embodiment of a linearly-polarized patch antenna with a capacitive radiating patch.
Figures 5B, 5C, 5D:
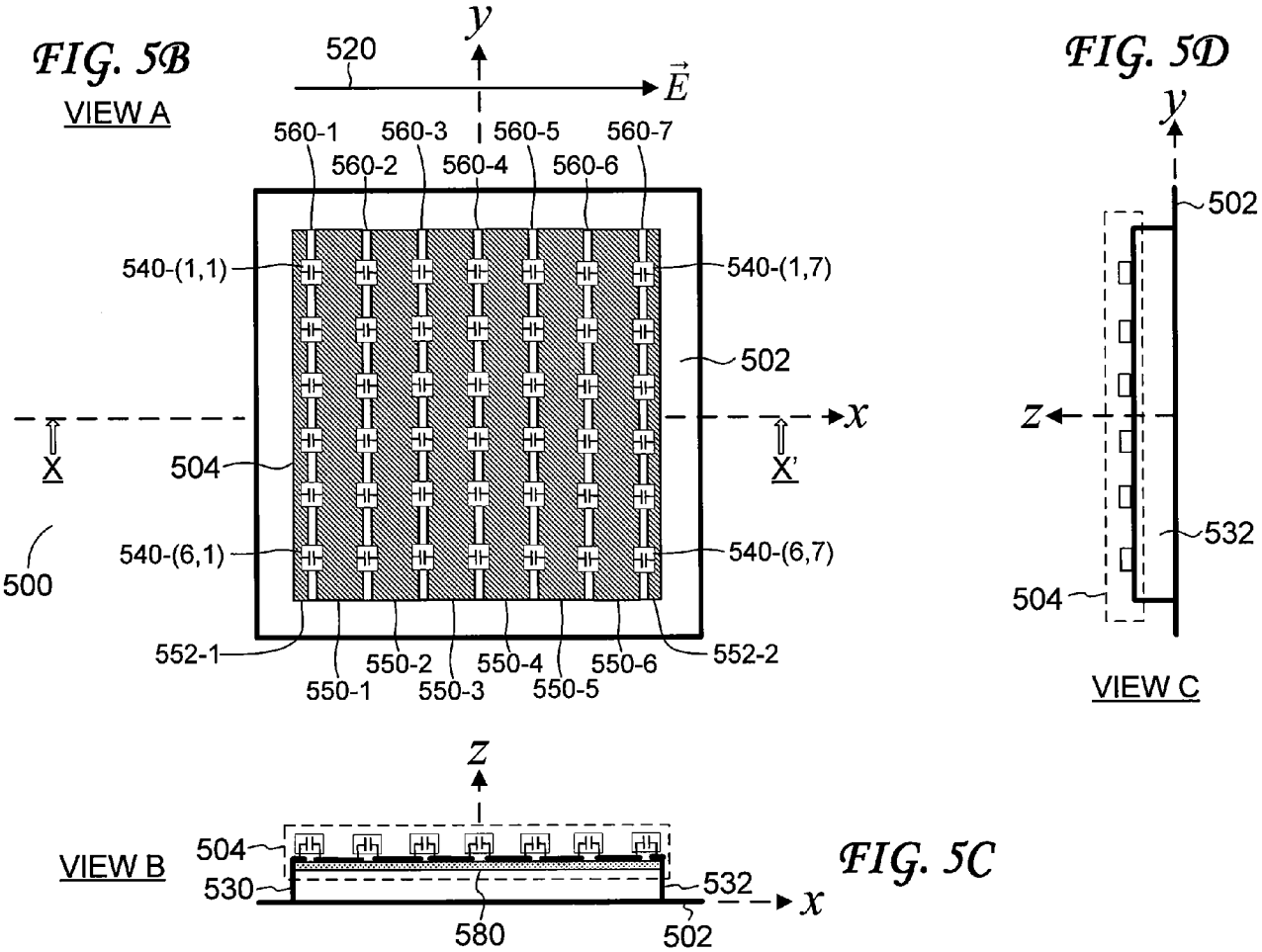

FIG. 5A-FIG. 5D show several views of a patch antenna 500, according to an embodiment of the invention. The patch antenna 500 is configured for linearly-polarized radiation. FIG. 5A shows a perspective view with a reference (x-y-z) Cartesian coordinate system. FIG. 5B shows a plan view (View A) sighted along the −z axis; FIG. 5B shows a side view (View B) sighted along the +y axis; and FIG. 5C shows a side view (View C) sighted along the −x axis.

Refer to FIG. 5A. The patch antenna 500 includes a ground plane 502, a capacitive radiating patch 504, vertical coupling elements 530 and vertical coupling elements 532. The E-field vector 520 is parallel to the +x axis. Refer to FIG. 5B-FIG. 5D. The ground plane 502 and the capacitive radiating patch 504 have rectangular geometries. In this example, the ground plane 502 is larger than the capacitive radiating patch 504.

The capacitive radiating patch 504 is fabricated using printed circuit techniques. A metal film deposited on the top side of a printed circuit board (PCB) 580 (FIG. 5C) is etched to form an array of rectangular conductive segments separated by slots. In the embodiment shown in FIG. 5A-FIG. 5D, the rectangular conductive segments are continuous along the y-axis and separated along the x-axis; these conductive segments are referred to as conductive strips. In the embodiment shown, there are eight conductive strips. The conductive strip 552-1 runs along the left-hand edge of the PCB 580, and the conductive strip 552-2 runs along the right-hand edge of the PCB 580. Conductive strips 550-1 . . . conductive strips 550-6 are configured between the conductive strip 552-1 and the conductive strip 552-2. The conductive strips are separated by slot 560-1 . . . slot 560-7. Note that the terms "left-hand edge", "right-hand edge", "top edge", and "bottom edge" are relative to View A in FIG. 5B and are used as a convenient reference in descriptions of geometrical configurations. In general, the regions along the perimeter of the radiating patch are referred to as peripheral regions.

One skilled in the art can fabricate capacitive radiating patch 504 by other techniques. For example, the conductive strips can be strips of sheet metal attached to an insulating board.

Adjacent conductive strips are bridged by multiple capacitors 540. The capacitors 540 are configured in a rectangular matrix and are indexed by (row, column) numbers. The capacitors 540 are indexed from capacitor 540-(1,1) . . . capacitor 540-(6,7). As one example, the conductive strip 552-1 and the conductive strip 550-1 are bridged by capacitor 540-(1,1) . . . capacitor 540-(6,1). As another example, the conductive strip 550-6 and the conductive strip 552-2 are bridged by capacitor 540-(1,7) . . . capacitor 540-(6,7). In some embodiments, the capacitors 540 are discrete devices soldered onto the conductive strips. In other embodiments, the capacitors 540 are integrated thin-film devices fabricated by printed circuit techniques.

The vertical coupling elements 530 are configured as a rectangular conductive strip electrically connected to the conductive strip 552-1 and electrically connected to the ground plane 502 (FIG. 5C). Similarly, the vertical coupling elements 532 are configured as a rectangular conductive strip electrically connected to the conductive strip 552-2 and electrically connected to the ground plane 502 (FIG. 5C and FIG. 5D). The vertical coupling elements 530 and the vertical coupling elements 532 can be fabricated from sheet metal or from metal film deposited on a printed circuit board.

In general, there are a conductive strip along the left-hand edge of PCB 580, a conductive strip along the right-hand edge of PCB 580, and N conductive strips in between (where N is an integer ≥1). The number of slots separating the conductive strips is then N+1. If two adjacent (consecutive) conductive strips are bridged by M capacitors (where M is an integer ≥1), then the total number of capacitors on a capacitive radiating patch is M(N+1).

In general, as the number of conductive strips increases, the distribution of the electric field parallel to the capacitive radiating patch and the ground plane becomes more uniform and the antenna performance improves (for example, the antenna directional pattern broadens). In general, the width of each conductive strip is independently variable. In general, the width of each slot between conductive strips is independently variable. In general, the spacing between any two capacitors along a conductive strip is independently variable. In general, the alignment of the capacitors on one conductive strip with respect to the alignment of the capacitors on another conductive strip is independently variable.

In some embodiments, the capacitance value of each capacitor is substantially equal. In general, the capacitance value of each capacitor is independently variable. The capacitance value depends on a number of design parameters such as the distance between the capacitor and the ground plane, the number of capacitors, and the operating frequency of the antenna. As one example, for an operating frequency of ~1300 MHz, a distance between the capacitor and the ground plane of ~5 mm, a capacitive radiating patch and a ground plane size of ~100 mm×100 mm, and ~10-12 capacitors in one row, the nominal capacitance value is ~1 pF.

Figures 6A, 6B, 6C:
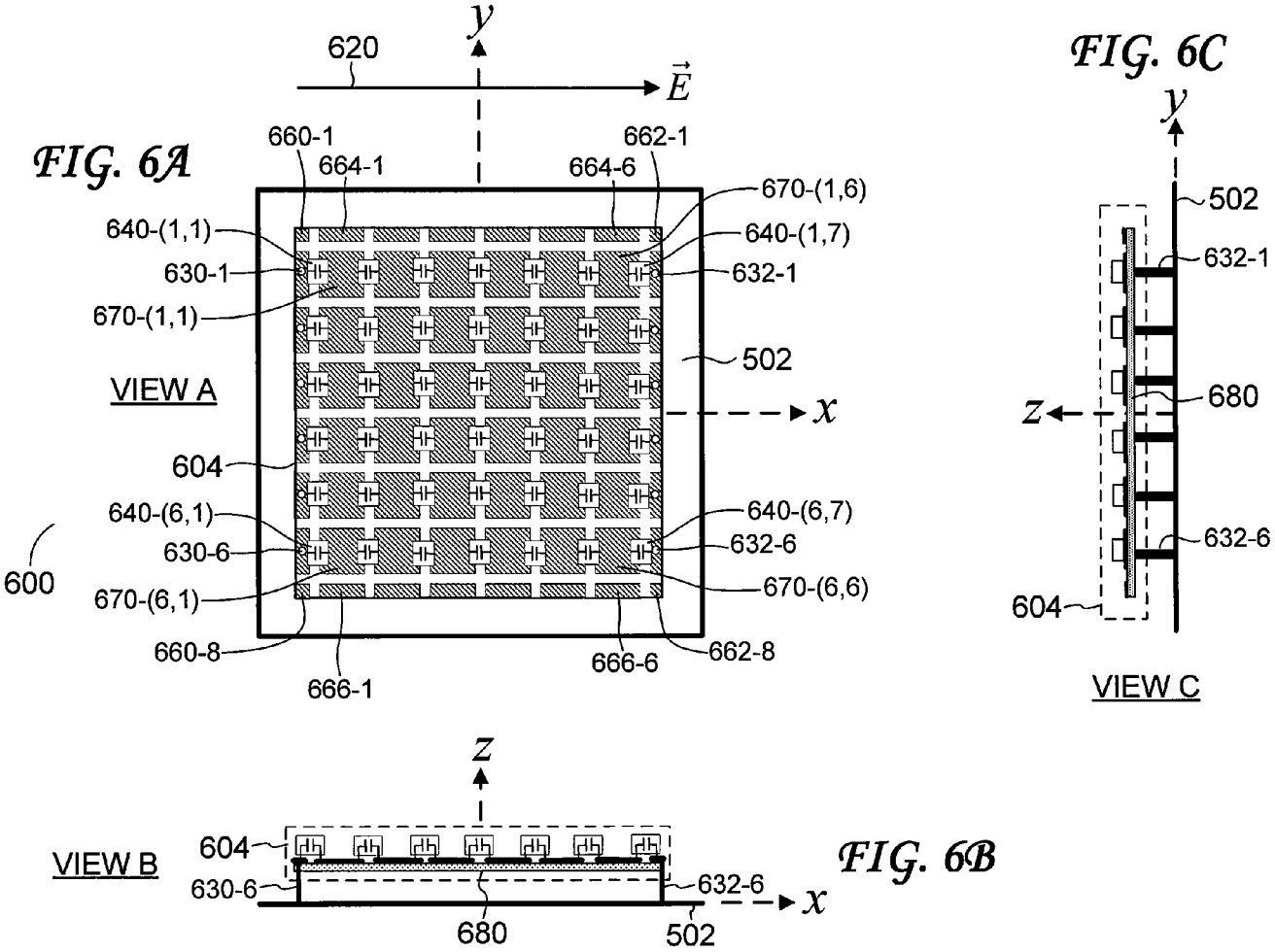
FIG. 6A-FIG. 6C show an embodiment of a linearly-polarized patch antenna with a capacitive radiating patch.

FIG. 6A-FIG. 6C show three views of a patch antenna 600, according to an embodiment of the invention. The perspective view (not shown) of the patch antenna 600 is similar to the perspective view of the patch antenna 500 (FIG. 5A). FIG. 6A-FIG. 6C show View A-View C, respectively, of the patch antenna 600.

The patch antenna 600 includes a ground plane 502 and a capacitive radiating patch 604. The capacitive radiating patch 604 is fabricated using printed circuit techniques. A metal film deposited on the top side of a printed circuit board (PCB) 680 (FIG. 6B and FIG. 6C) is etched to form an array of rectangular conductive segments separated by slots. The rectangular conductive segments are separated along the x-axis and separated along the y-axis. The E-field vector 620 is parallel to the +x axis.

In the embodiment shown, there are five groups of conductive segments. The conductive segment group 660 (which includes conductive segment 660-1 . . . conductive segment 660-8) is configured as a column along the left-hand edge of PCB 680. The conductive segment group 662 (which includes conductive segment 662-1 . . . conductive segment 662-8) is configured as a column along the right-hand edge of PCB 680. The conductive segment group 664 (which includes conductive segment 664-1 . . . conductive segment 664-6) is configured as a row along the top edge of PCB 680. The conductive segment group 666 (which includes conductive segment 666-1 . . . conductive segment 666-6) is configured as a row along the bottom edge of PCB 680. The conductive segment group 670 is configured as a two-dimensional matrix between the edges of the PCB 680. The conductive segments in conductive segment group 670 are indexed by (row, column) numbers, ranging from conductive segment 670-(1,1) . . . conductive segment 670-(6,6).

Adjacent conductive segments are bridged by capacitors 640 along the x-axis. The individual capacitors are indexed by (row, column), ranging from capacitor 640-(1,1) . . . capacitor 640-(6,7). For example, conductive segment 630-1 and conductive segment 670-(1,1) are bridged by capacitor 640-(1,1); and conductive segment 670-(6,6) and conductive segment 662-7 are bridged by capacitor 640-(6,7).

Vertical coupling elements 630 (FIG. 6A and FIG. 6B) are configured as a set of conductive pins, denoted vertical coupling element 630-1 . . . vertical coupling element 630-6. Similarly, vertical coupling elements 632 (FIG. 6A and FIG. 6C) are configured as a set of conductive pins, denoted vertical coupling element 632-1 . . . vertical coupling element 632-6. The cross-sectional geometry of a pin is user-defined; for example, the cross-section can be circular, elliptical, square, rectangular, or polygonal. For each pin, one end is electrically connected to a conductive segment on the capacitive radiating patch 604, and the other end is electrically connected to the ground plane 502. For example, the vertical coupling element 630-1 is electrically connected to the conductive segment 660-2 and electrically connected to the ground plane 502; and the vertical coupling element 632-6 is electrically connected to the conductive segment 662-7 and electrically connected to the ground plane 502. For electrical connection to a conductive segment, the pin can be inserted through a via hole in PCB 680 and soldered onto the conductive segment.

Figures 7A, 7B, 7C:
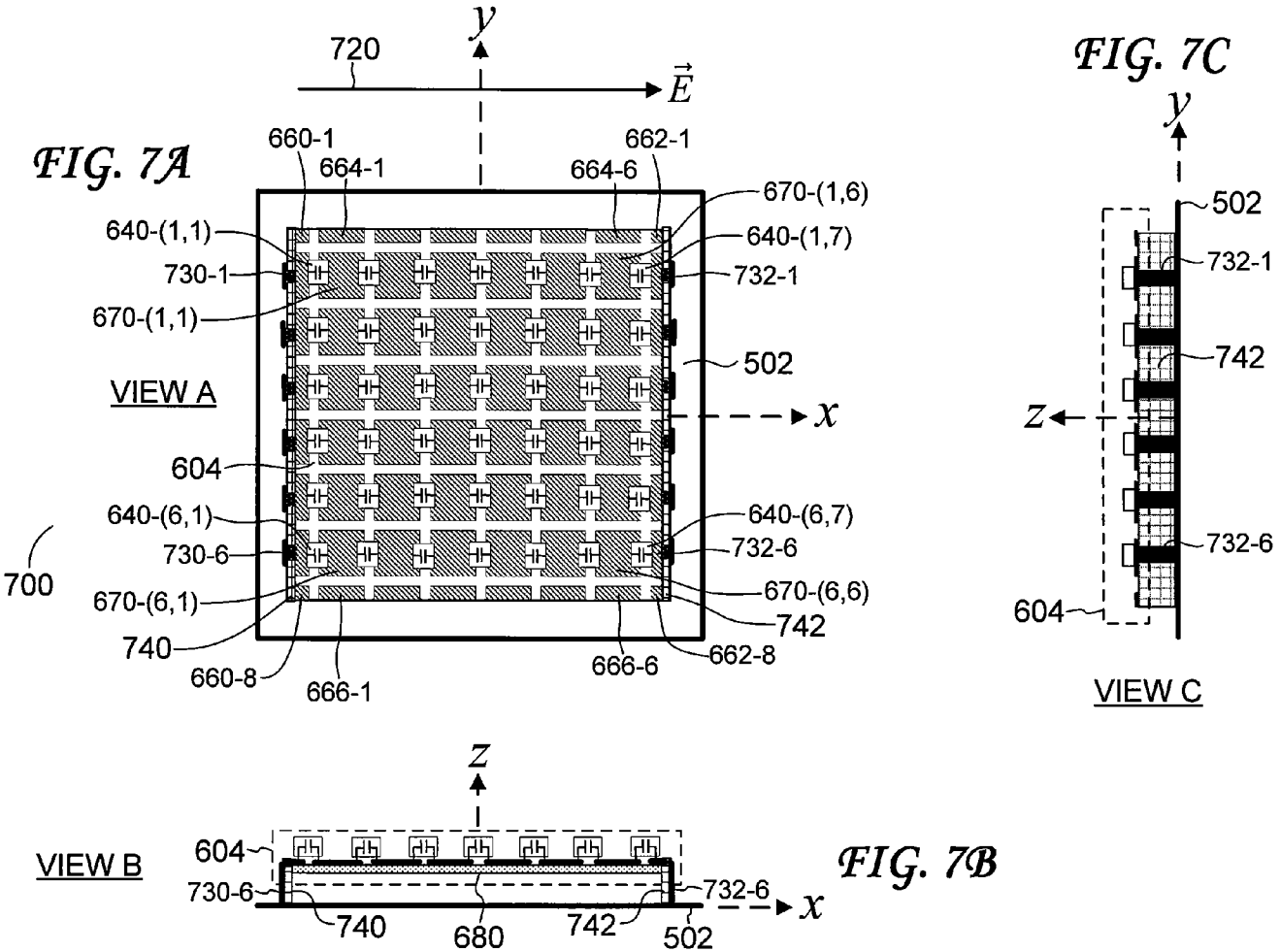
FIG. 7A-FIG. 7C show an embodiment of a linearly-polarized patch antenna with a capacitive radiating patch.

FIG. 7A-FIG. 7C show View A-View C, respectively of a patch antenna 700, according to an embodiment of the invention. The patch antenna 700 is similar to the patch antenna 600 (FIG. 6A-FIG. 6C), except for details of the vertical coupling elements. In the patch antenna 700, on the left-hand side, the vertical coupling elements 730 are formed from metallization on a printed circuit board 740. The individual vertical coupling elements are denoted vertical coupling element 730-1 . . . vertical coupling element 730-6. On the right-hand side, the vertical coupling elements 732 are formed from metallization on a printed circuit board 742. The individual vertical coupling elements are denoted vertical coupling element 732-1 . . . vertical coupling element 732-6. The vertical coupling elements 732 are shown in FIG. 7C. For example, the vertical coupling element 732-1 is electrically connected to the conductive segment 662-2 and electrically connected to the ground plane 502; and the vertical coupling element 732-6 is electrically connected to the conductive segment 662-7 and electrically connected to the ground plane 502. The E-field vector 720 is parallel to the +x axis.

Figures 8A, 8B, 8C:
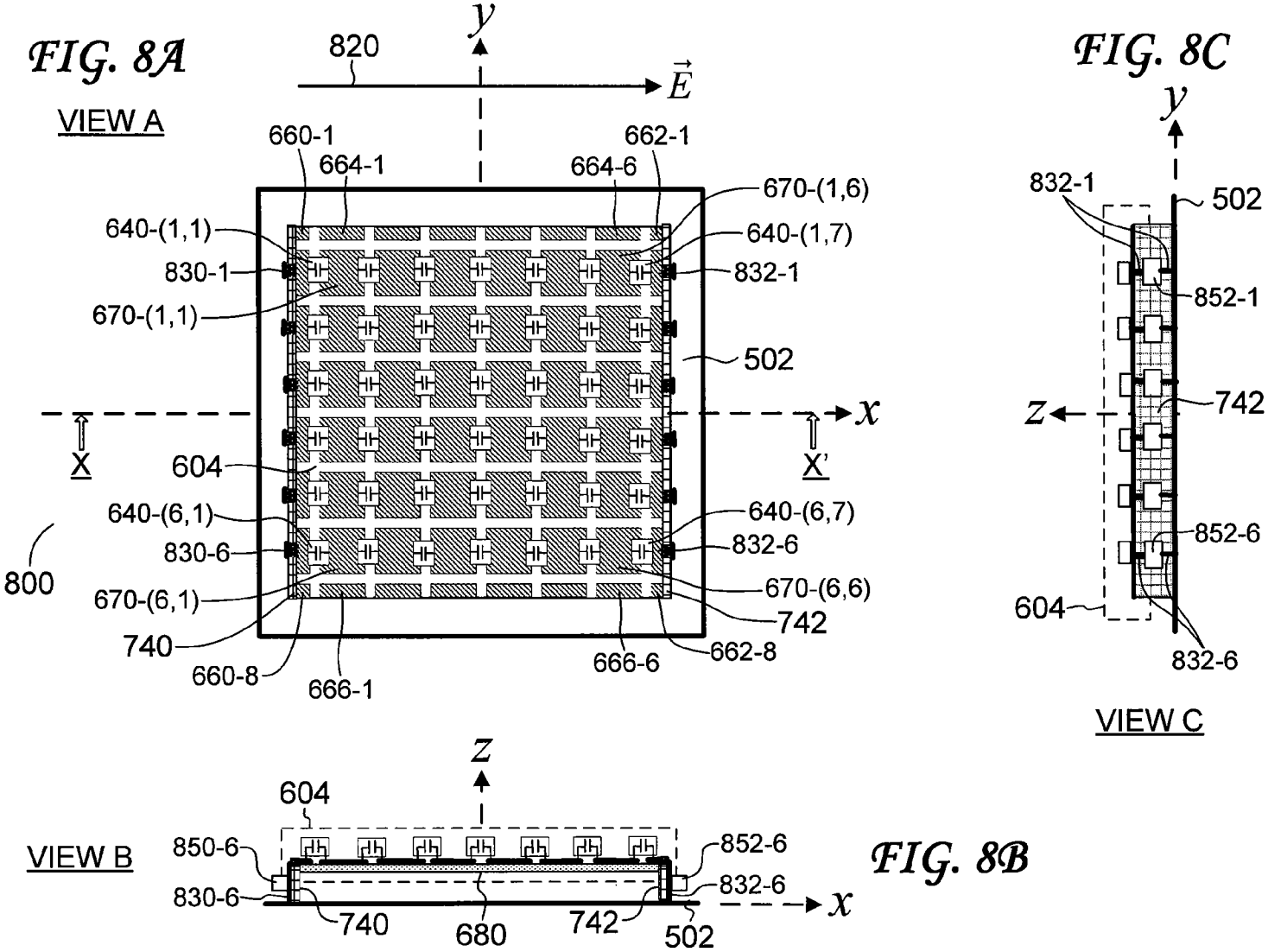
FIG. 8A-FIG. 8C show an embodiment of a linearly-polarized patch antenna with a capacitive radiating patch.

FIG. 8A-FIG. 8C show View A-View C, respectively, of a patch antenna 800, according to an embodiment of the invention. The patch antenna 800 is similar to the patch antenna 700 (FIG. 7A-FIG. 7C), except for details of the vertical coupling elements. In the patch antenna 700, the vertical coupling elements 730 and the vertical coupling elements 732 are conductive segments. In the patch antenna 800, the vertical coupling elements 850 and the vertical coupling elements 852 are generalized RLC elements.

Herein, RLC elements refer to user-defined combinations of resistors, inductors, and capacitors in series and parallel combinations. For each RLC element, the value of R ranges from 0 to R(max), the value of L ranges from 0 to L(max), and the value of C ranges from 0 to C(max). An RLC element can have active impedance, reactive impedance, or combined active and reactive impedance. For each RLC element, the values (R, L, C) and circuit configurations can be independently user-specified.

The RLC elements are electrically connected to the capacitive radiating patch 604 and electrically connected to the ground plane 502 by conductive leads 830 on PCB 740 and conductive leads 832 on PCB 742. FIG. 8C shows a detailed view. The RLC element 852-1 is electrically connected by conductive leads 832-1 to the conductive segment 662-2 and to the ground plane 502. Similarly, the RLC element 852-6 is electrically connected by conductive leads 832-6 to the conductive segment 662-7 and to the ground plane 502.

In some embodiments, the RLC elements are fabricated from discrete components electrically connected by point-to-point wiring. In other embodiments, the RLC elements are fabricated as integrated thin-film devices.

The number of RLC elements along the left-hand side and the number of RLC elements along the right-hand side are independently adjustable. The spacing between adjacent RLC elements is independently adjustable. The spacings can be constant or variable. The (R, L, C) values and circuit configuration of each RLC element are independently adjustable.

Figure 9A:
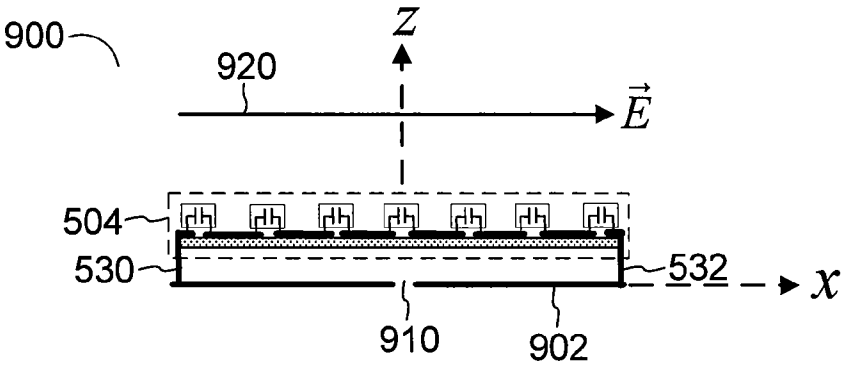
FIG. 9A and FIG. 9B show an embodiment of a linearly-polarized patch antenna with a capacitive radiating patch and a slotted ground plane.
Figure 9B:
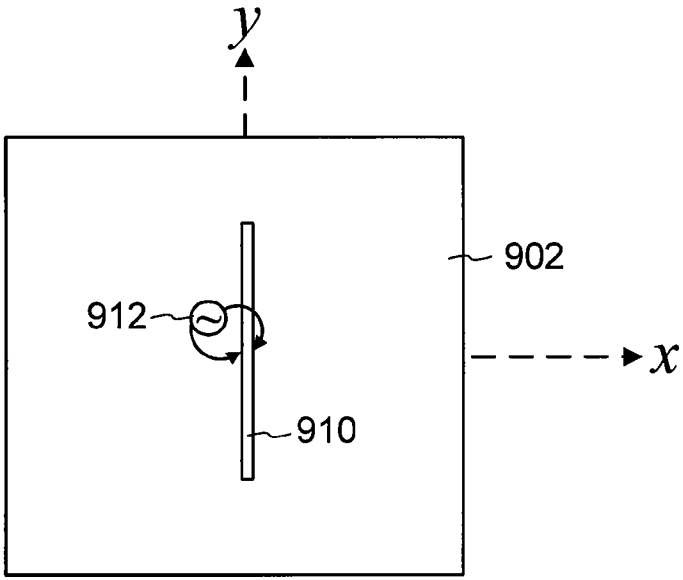

FIG. 9A shows a cross-sectional view (View X-X') of a patch antenna 900, according to an embodiment of the invention. The patch antenna 900 is similar to the patch antenna 500 (FIG. 5C), except for the ground plane and feed system. In the patch antenna 900, the ground plane 902 has a slot 910. FIG. 9B shows a plan view (sighted along the −z axis) of only the ground plane 902. The slot 910 is fed by an excitation source 912 such that the E-field vector 920 is parallel to the +x axis. The excitation source 912 can a radiofrequency (RF) transmitter coupled to the slot 910 via a coaxial cable or a stripline. The size of the slot depends on various design parameters. In some embodiments, the length of the slot ranges from ~(0.2-0.4)$\lambda_0$, and the width of the slot ranges from ~(0.001-0.05)$\lambda_0$, where $\lambda_0$ is the wavelength of the received electromagnetic radiation in free space.

Figures 10A, 10B, 10C:
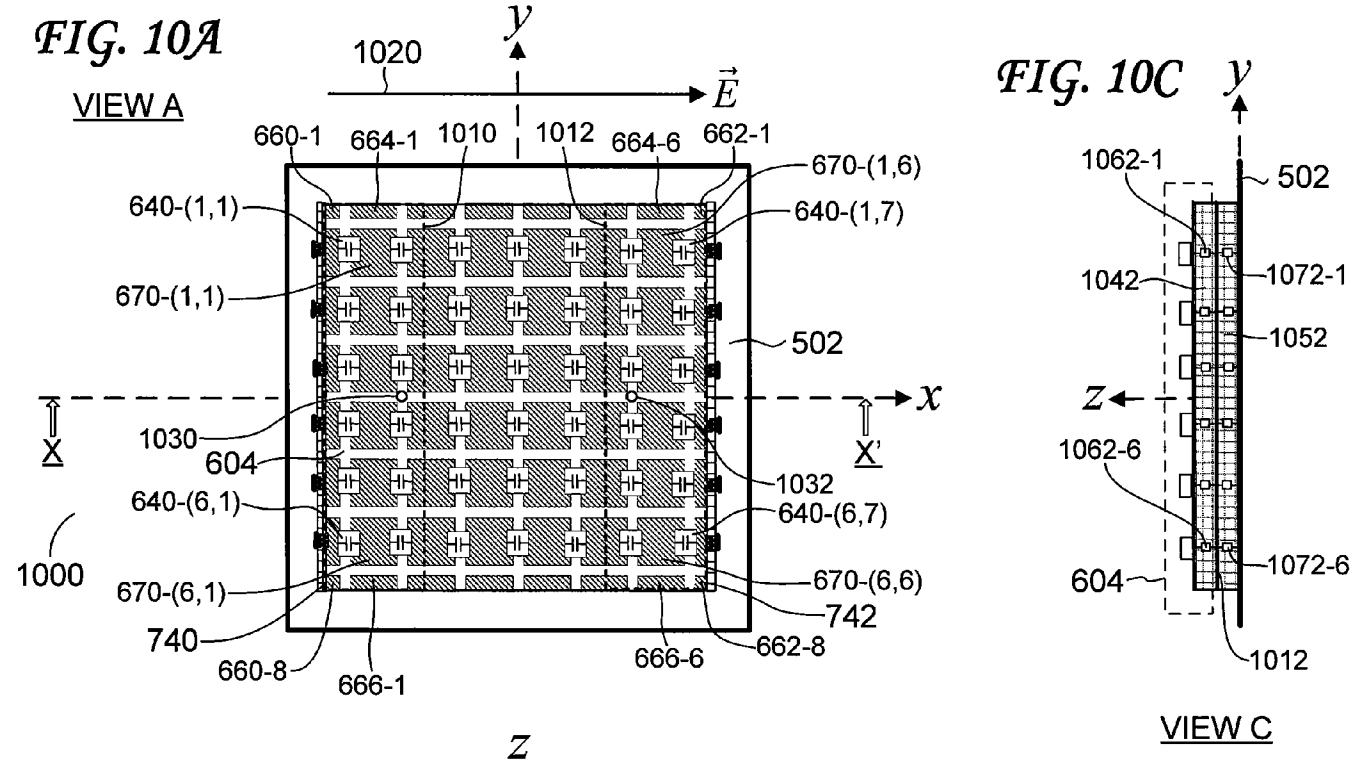
FIG. 10A-FIG. 10C show an embodiment of a linearly-polarized patch antenna with a capacitive radiating patch and a pin excitation system.

FIG. 10A-FIG. 10C show views of a linearly-polarized patch antenna 1000, according to an embodiment of the invention. The patch antenna 1000 includes a pin feeding system. FIG. 10A shows View A, FIG. 10B shows a cross-sectional view (View X-X'), and FIG. 10C shows View C of the patch antenna 1000. The patch antenna 1000 includes a capacitive radiating patch 604 (as described above with reference to FIG. 6A-FIG. 6C) and a ground plane 502. Disposed between the capacitive radiating patch 604 and the ground plane 502 are two feed patches, denoted feed patch 1010 and feed patch 1012. The dimensions of a feed patch depends on various design parameters. In some embodiments, the dimension along the x-axis ranges from ~(0.10-0.25)$\lambda_0$.

Refer to FIG. 10A and FIG. 10B. Disposed between the feed patch 1010 and the ground plane 502 is an excitation source 1030. Similarly, disposed between the feed patch 1012 and the ground plane 502 is an excitation source 1032. The excitation sources are configured along the x-axis of symmetry of the feed patches. The excitation source 1030 and the excitation source 1032 are 180 deg out-of-phase, and the E-field vector 1020 is parallel to the x-axis.

In the patch antenna 1000, there are four sets of vertical coupling elements. Refer to FIG. 10C. On the right-hand side, the vertical coupling elements 1062 (vertical coupling element 1062-1 . . . vertical coupling element 1062-6) are electrically connected to conductive segments on the capacitive radiating patch 604 and electrically connected to the feed patch 1012. The vertical coupling elements 1072 (vertical coupling element 1072-1 . . . vertical coupling element 1072-6) are electrically connected to the feed patch 1012 and electrically connected to the ground plane 502. Similarly, on the left-hand side (not shown), one set of vertical coupling elements are electrically connected to conductive segments on the capacitive radiating patch 604 and electrically connected to the feed patch 1010, and another set of vertical coupling elements are electrically connected to the feed patch 1010 and electrically connected to the ground plane 502.

In the embodiment shown in FIG. 10A-FIG. 10C, the vertical coupling elements are fabricated on printed circuit boards (PCBs): PCB 1040 and PCB 1050 on the left-hand side, and PCB 1042 and PCB 1052 on the right-hand side. Refer to FIG. 10C for details of the right-hand side. The vertical coupling elements 1062 are fabricated on PCB 1042; and the vertical coupling elements 1072 are fabricated on PCB 1052. The vertical coupling elements can be conductive segments, or in general, RLC elements. The RLC elements can be configured to optimize the radiation pattern and to reduce mulitpath reception (important for navigation receivers).

Figures 11A, 11B, 11C:
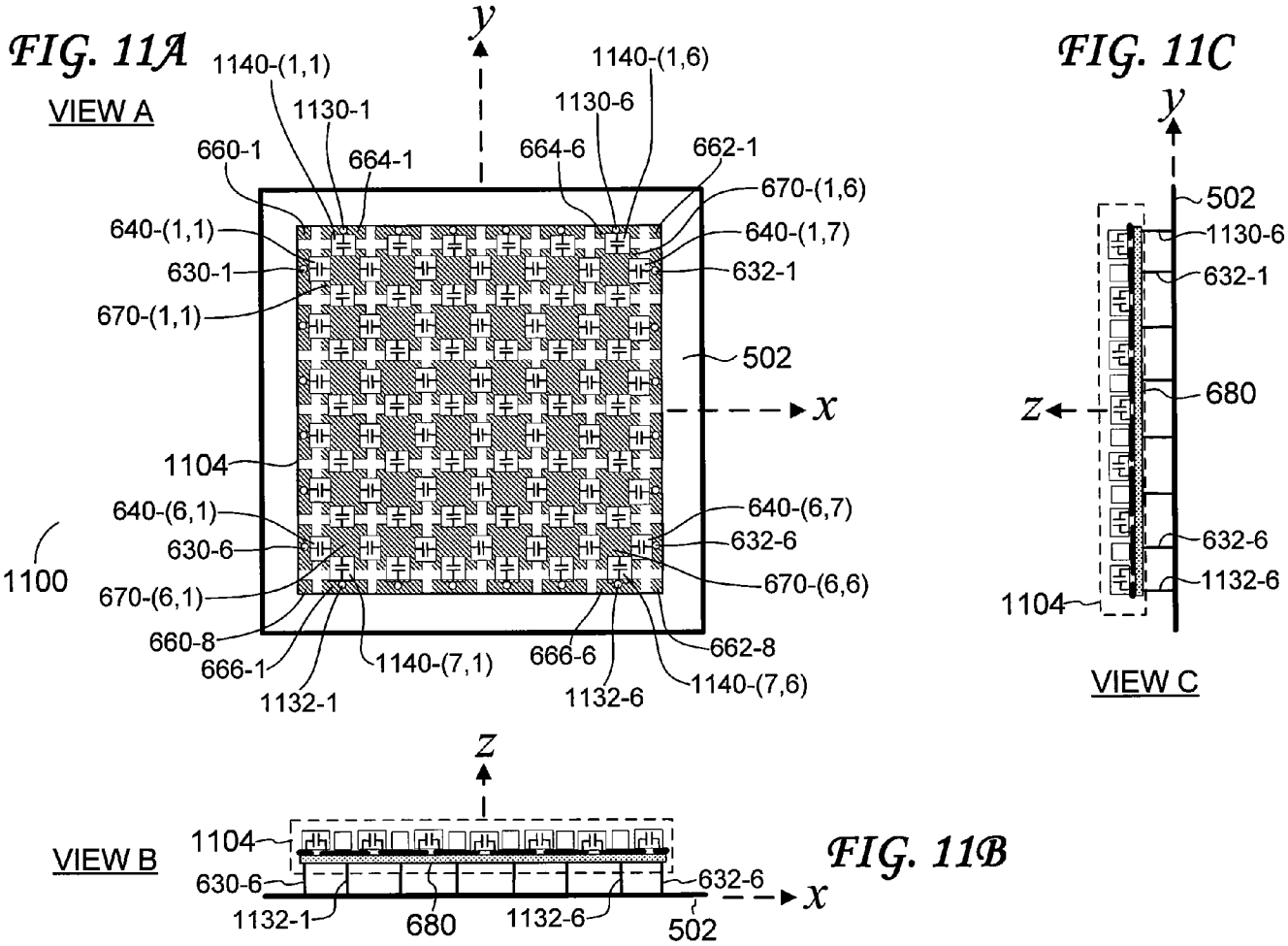
FIG. 11A-FIG. 11C show an embodiment of a circularly-polarized patch antenna with a capacitive radiating patch.

FIG. 11A-FIG. 11C show View A-View C, respectively, of a circularly-polarized patch antenna 1100, according to an embodiment of the invention. The patch antenna 1100 includes all the features of the linearly-polarized patch antenna 600 (FIG. 6A-FIG. 6C) plus corresponding orthogonal features. Features in FIG. 11A-FIG. 11C that are in common with the features in FIG. 6A-FIG. 6C are denoted with the same reference numbers 6XX. New features in FIG. 11A-FIG. 11C are denoted with the reference numbers 11XX.

The patch antenna 1100 includes a ground plane 502 and a capacitive radiating patch 1104. Adjacent conductive segments are bridged by capacitors 1140 along the y-axis. The individual capacitors are indexed by (row, column), ranging from capacitor 1140-(1,1) . . . capacitor 1140-(7,6). For example, the conductive segment 664-1 and the conductive segment 670-(1,1) are bridged by the capacitor 1140-(1,1); and the conductive segment 670-(6,6) and the conductive segment 666-6 are bridged by the capacitor 1140-(7,6).

Vertical coupling elements are configured along the top edge (vertical coupling elements 1130) and along the bottom edge (vertical coupling elements 1132) of the capacitive radiating patch 1104. Vertical coupling elements 1130 are configured as a set of conductive pins, denoted vertical coupling element 1130-1 . . . vertical element 1130-6. Similarly, vertical coupling elements 1132 are configured as a set of conductive pins, denoted vertical coupling element 1132-1 . . . vertical coupling element 1132-6. For each pin, one end is electrically connected to a conductive segment on the capacitive radiating patch 1104, and the other end is electrically connected to the ground plane 502. For example, the vertical coupling element 1130-1 is electrically connected to conductive segment 664-1 and electrically connected to the ground plane 502; and the vertical coupling element 1132-6 is electrically connected to the conductive segment 666-6 and electrically connected to the ground plane 502. For electrical connection to a conductive segment, the pin can be inserted through a via hole in PCB 680 and soldered onto the conductive segment.

Figure 12C:
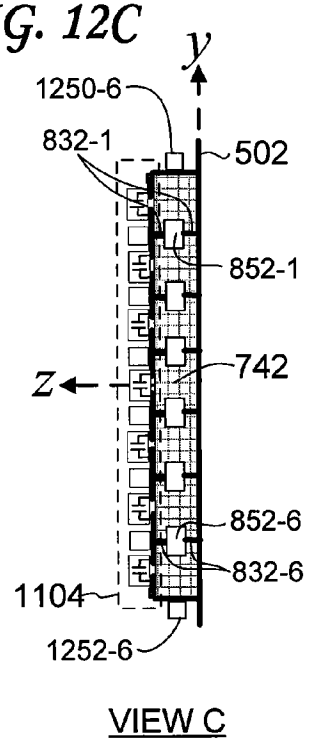
FIG. 12A-FIG. 12C show an embodiment of a circularly-polarized patch antenna with a capacitive radiating patch.
Figure 12A:
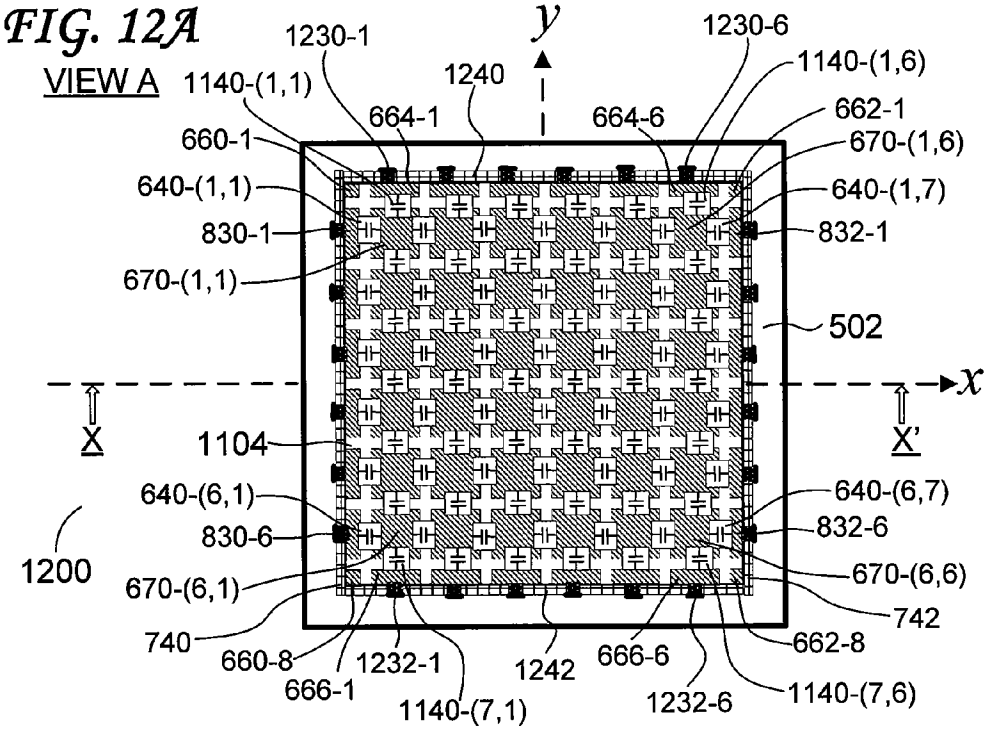
Figure 12B:
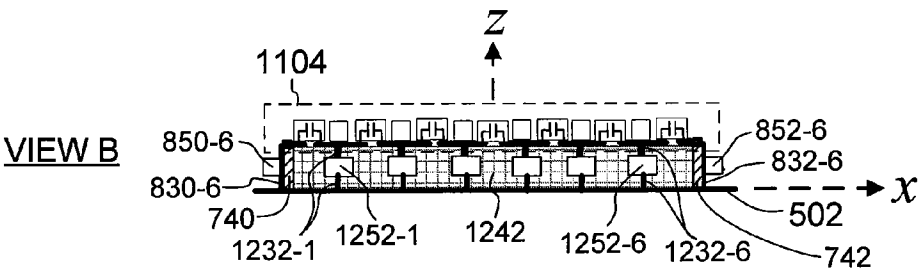

FIG. 12A-FIG. 12C show View A-View C, respectively, of a circularly-polarized patch antenna 1200, according to an embodiment of the invention. The patch antenna 1200 includes all the features of the linearly-polarized patch antenna 800 (FIG. 8A-FIG. 8C) plus corresponding orthogonal features. Features in FIG. 12A-FIG. 12C that are in common with the features in FIG. 8A-FIG. 8C are denoted with the same reference numbers 8XX. New features in FIG. 12A-FIG. 12C are denoted with the reference numbers 12XX.

The patch antenna 1200 includes a capacitive radiating patch 1104 and a ground plane 502. The vertical coupling elements 850 and the vertical coupling elements 852 are described above with reference to FIG. 8A-FIG. 8B. There are similar vertical coupling elements 1250 and vertical coupling elements 1252 on the edges parallel to the x-axis. The vertical coupling elements 1250 (vertical coupling element 1250-1 . . . vertical coupling element 1250-6) are fabricated on PCB 1240 along the top edge of the capacitive radiating patch 1104. Similarly, the vertical coupling elements 1252 (vertical coupling element 1252-1 . . . vertical coupling element 1252-6) are fabricated on PCB 1242 along the bottom edge of the capacitive radiating patch 1104.

The vertical coupling elements are electrically connected to the capacitive radiating patch 1104 and electrically connected to the ground plane 502 by conductive leads 1230 on PCB 1240 and conductive leads 1232 on PCB 1242. FIG. 12B shows a detailed view of PCB 1242. The vertical coupling element 1252-1 is electrically connected by conductive leads 1232-1 to the conductive segment 666-1 and to the ground plane 502. Similarly, the vertical coupling element 1252-6 is electrically connected by conductive leads 1232-6 to the conductive segment 666-6 and to the ground plane 502.

Figure 13A:
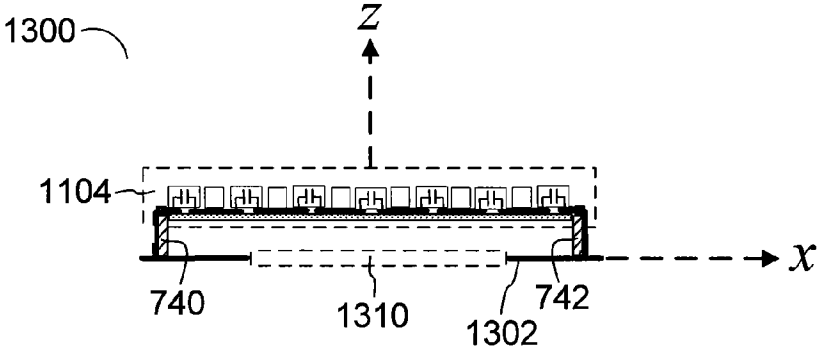
FIG. 13A and FIG. 13B show an embodiment of a circularly-polarized patch antenna with a capacitive radiating patch and a slotted ground plane.
Figure 13B:
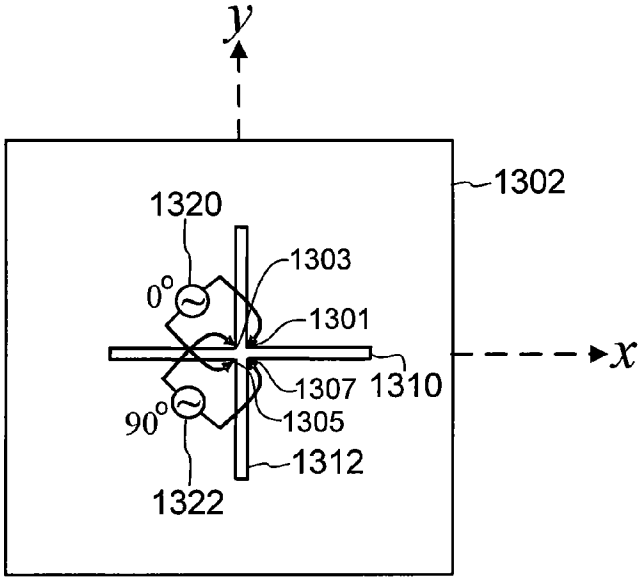

FIG. 13A shows a cross-sectional view (View X-X') of a circularly-polarized patch antenna 1300, according to an embodiment of the invention. The patch antenna 1300 is similar to the patch antenna 1200 (FIG. 12A-FIG. 12C), except for the ground plane and feed system. In the patch antenna 1300, the ground plane 1302 has two orthogonal slots, slot 1310 and slot 1312. FIG. 13B shows a plan view (sighted along the −z axis) of only the ground plane 1302. The slot 1310 and the slot 1312 are fed by an excitation source 1320 and an excitation source 1322, which is 90 deg out-of-phase from the excitation source 1320. The excited electromagnetic field is the vector sum of two orthogonal linear polarizations. The output of the excitation source 1320 is fed into the feed point 1301 and the feed point 1305. The output of the excitation source 1322 is fed into the feed point 1303 and the feed point 1307. The size of the slot depends on various design parameters. In some embodiments, the length of the slot ranges from ~(0.2-0.4)$\lambda_0$, and the width of the slot ranges from ~(0.001-0.05)$\lambda_0$.

The excitation source 1320 and the excitation source 1322 can be generated as the outputs of a quadrature bridge (power splitter). The input of the quadrature bridge is the antenna input/output, which is connected to a transmitter/receiver. In another embodiment, the ground plane 1302 has four separate orthogonal slots. Each slot is excited by an excitation source. The four excitation sources are phase-shifted by 0, 90, 180, and 270 deg, respectively.

Figure 14A:
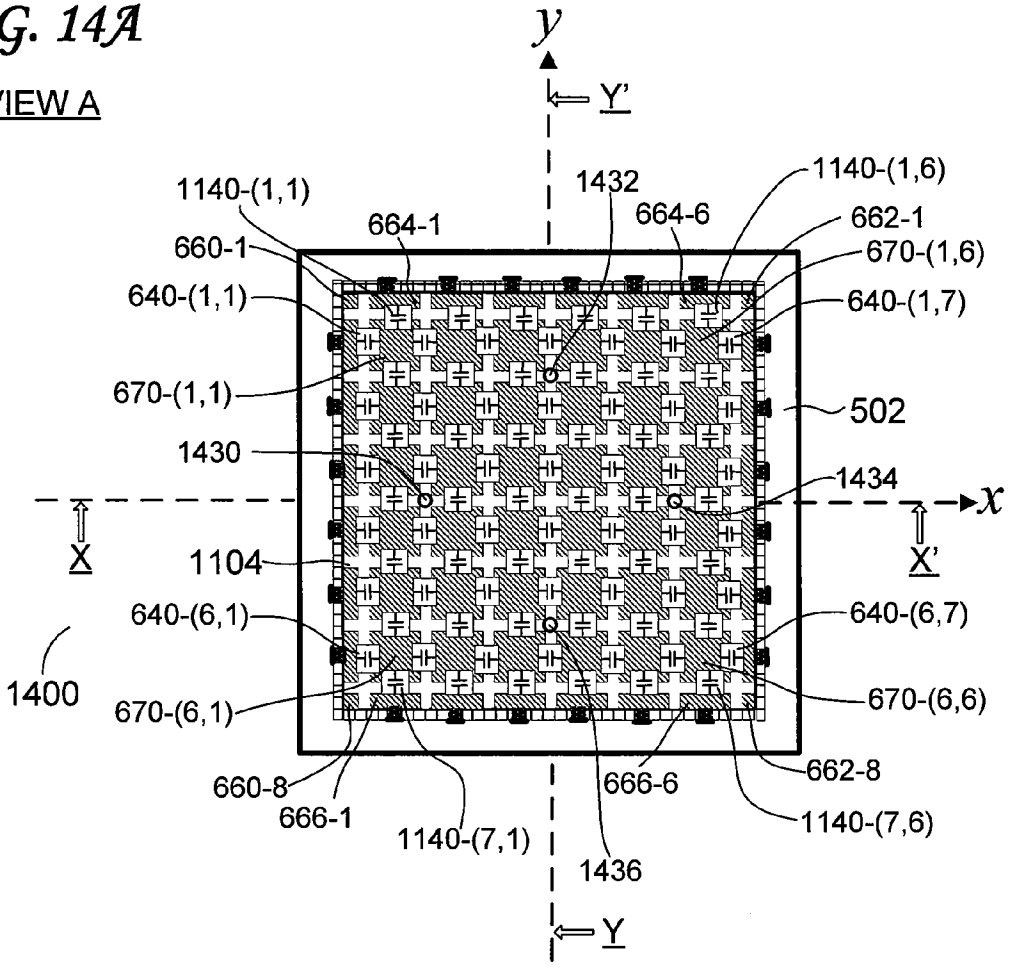
FIG. 14A-FIG. 14E show an embodiment of a circularly-polarized patch antenna with a capacitive radiating patch and a feed patch.
Figure 14D:
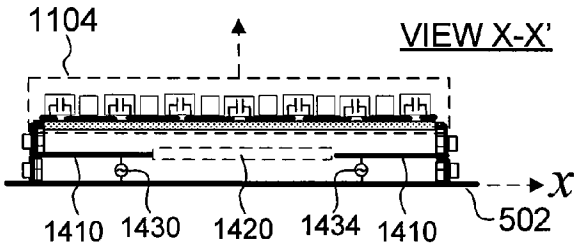
Figure 14E:
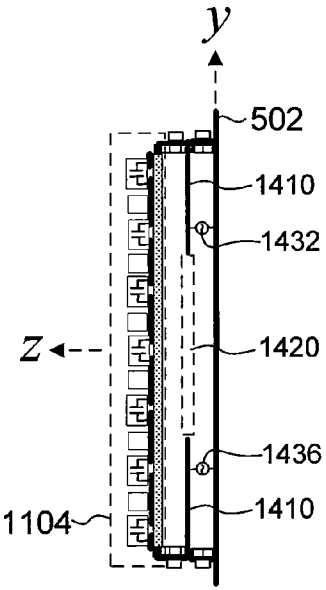
Figure 14B:
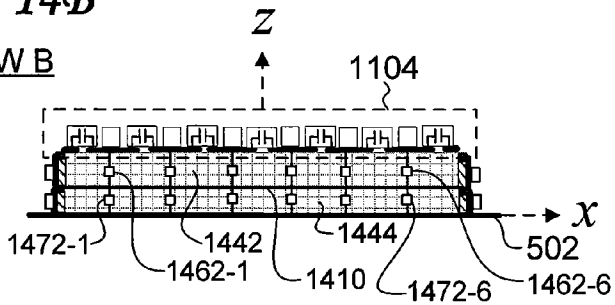
Figure 14C:
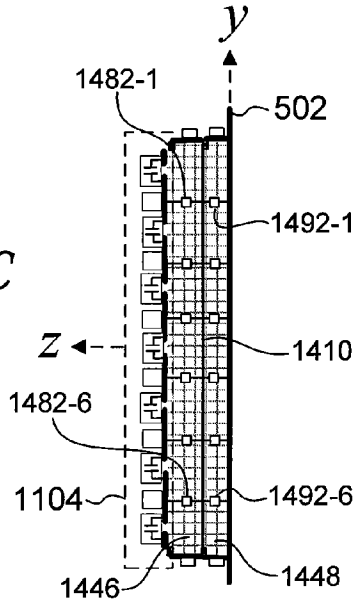

FIG. 14A-FIG. 14E show various views of a circularly-polarized patch antenna 1400, according to an embodiment of the invention. FIG. 14A (View A) is similar to FIG. 12A. FIG. 14B and FIG. 14C show View B and View C, respectively. FIG. 14D shows a first cross-sectional view (View X-X'), and FIG. 14E shows a second cross-sectional view (View Y-Y').

The patch antenna 1400 includes a capacitive radiating patch 1104 and a ground plane 502. The patch antenna 1400 includes a feed patch 1410 disposed between the capacitive radiating patch 1104 and the ground plane 502 (compare FIG. 10A-FIG. 10C for the linearly-polarized patch antenna 1000 with the feed patch 1010 and the feed patch 1012).

Figure 15B:
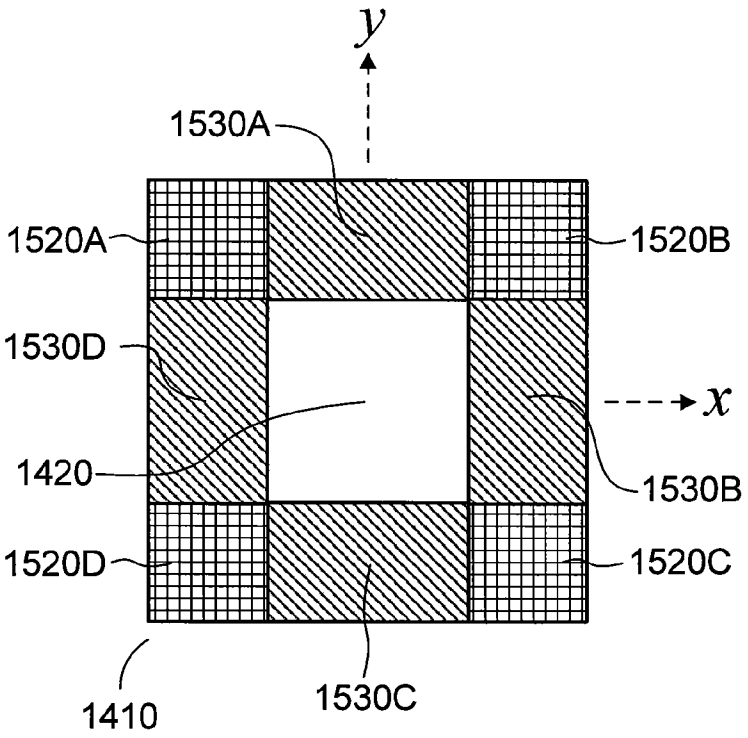
FIG. 15A and FIG. 15B show embodiments of a feed patch for a circularly-polarized patch antenna.
Figure 15A:
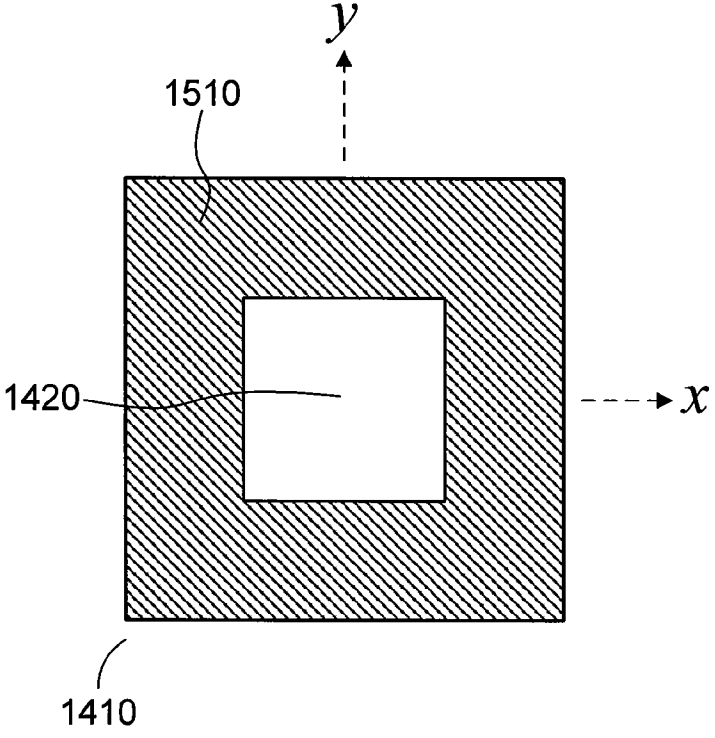

FIG. 15A and FIG. 15B show plan views (sighted along the −z axis) of two embodiments of the feed patch 1410. In FIG. 15A, the feed patch 1410 is formed from a conductor 1510 with a cutout 1420. The conductor 1510, for example, can be sheet metal or a metal film deposited on a printed circuit board. In FIG. 15B, the feed patch 1410 is formed on a printed circuit board with a cutout 1420. Region 1530A-region 1530D denote conductive regions (for example, metallization). Region 1520A-region 1520D denote insulating regions (for example, no metallization).

Refer back to FIG. 14A, FIG. 14D, and FIG. 14E. The patch antenna 1400 includes a pin feeding system. Disposed between the feed patch 1410 and the ground plane 502 are four orthogonally placed excitation sources. The excitation source 1430 and the excitation source 1434 are configured along the x-axis of symmetry of the feed patch 1410. The excitation source 1432 and the excitation source 1436 are configured along the y-axis of symmetry of the feed patch 1410. The excitation source 1430, the excitation source 1432, the excitation source 1434, and the excitation source 1436 are phase-shifted by 0, 90, 180, and 270 deg, respectively. The excitation sources, for example, can be provided from the outputs of a four-port power splitter.

Vertical coupling elements are configured along all four edges of the capacitive radiating patch 1104. Refer to FIG. 14B. Vertical coupling elements 1462 (including vertical coupling element 1462-1 . . . vertical coupling element 1462-6) are fabricated on PCB 1442. The vertical coupling elements 1462 are electrically connected to conductive segments along the bottom edge of the capacitive radiating patch 1104 and electrically connected to the feed patch 1410. Vertical coupling elements 1472 (including vertical coupling element 1472-1 . . . vertical coupling element 1472-6) are fabricated on PCB 1444. The vertical coupling elements 1472 are electrically connected to the feed patch 1410 and electrically connected to the ground plane 502.

Refer to FIG. 14C. Vertical coupling elements 1482 (including vertical coupling element 1482-1 . . . vertical coupling element 1482-6) are fabricated on PCB 1446. The vertical coupling elements 1482 are electrically connected to conductive segments along the right-hand edge of the capacitive radiating patch 1104 and electrically connected to the feed patch 1410. Vertical coupling elements 1492 (including vertical coupling element 1492-1 . . . vertical coupling element 1492-6) are fabricated on PCB 1448. The vertical coupling elements 1492 are electrically connected to the feed patch 1410 and electrically connected to the ground plane 502.

Similar vertical coupling elements (not shown) are configured along the top edge and the left edge of the capacitive radiating patch 1104. The vertical coupling elements can be conductive segments or RLC elements.

Figures 16A, 16B, 16C:
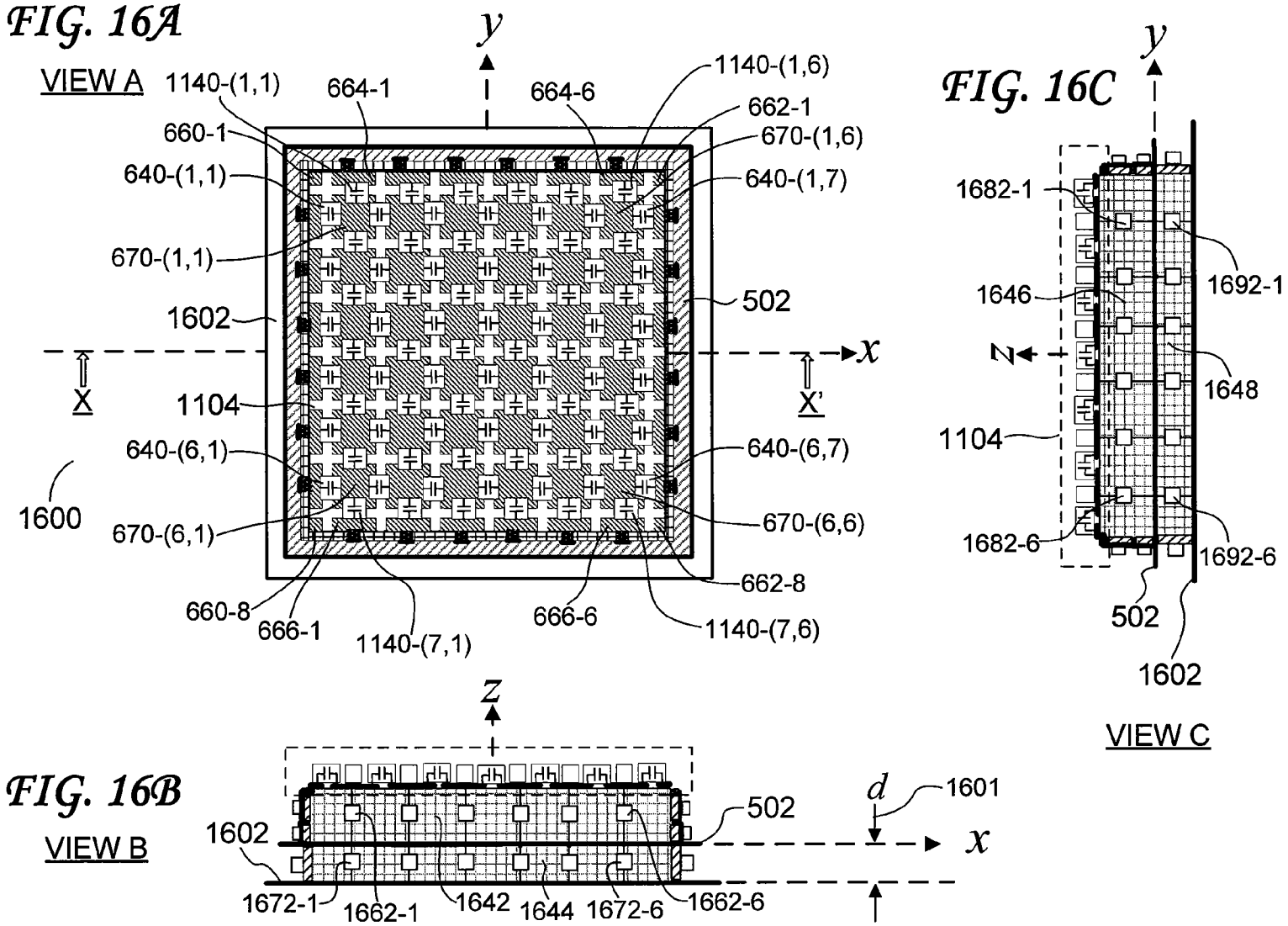
FIG. 16A-FIG. 16C show an embodiment of a circularly-polarized patch antenna with a capacitive radiating patch and a secondary ground plane.

FIG. 16A-FIG. 16C show View A-View C, respectively, of a circularly-polarized patch antenna 1600, according to an embodiment of the invention. The patch antenna 1600 includes a capacitive radiating patch 1104, a primary ground plane 502, and a secondary ground plane 1602. The primary ground plane 502 has a slot excitation system (not shown) similar to the one shown in FIG. 13A and FIG. 13B above. The secondary ground plane 1602 reduces the radiation pattern level in the backward hemisphere and, therefore, reduces multipath reception. In one embodiment, the size of the secondary ground plane 1602 is the same as the size of the primary ground plane 502. In other embodiments, the size of the secondary ground plane 1602 can be greater than or smaller than the size of the primary ground plane 502. The primary ground plane 502 and the secondary ground plane 1602 can have the same geometrical shapes or different geometrical shapes. The vertical distance d 1601 between the primary ground plane 502 and the secondary ground plane 1602 is user-defined. In some embodiments, d is approximately (0.02-0.1) λ, where λ is the wavelength of the received electromagnetic radiation.

Vertical coupling elements are configured along all four edges of the capacitive radiating patch 1104. Refer to FIG. 16B for details of the bottom edge. Vertical coupling elements 1662 (including vertical coupling element 1662-1 . . . vertical coupling element 1662-6) are fabricated on PCB 1642. The vertical coupling elements 1662 are electrically connected to conductive segments along the bottom edge of the capacitive radiating patch 1104 and electrically connected to the primary ground plane 502. Vertical coupling elements 1672 (including vertical coupling element 1672-1 . . . vertical coupling element 1672-6) are fabricated on PCB 1644. The vertical coupling elements 1672 are electrically connected to the primary ground plane 502 and electrically connected to the secondary ground plane 1602.

Refer to FIG. 16C for details of the right-hand edge. Vertical coupling elements 1682 (including vertical coupling element 1682-1 . . . vertical coupling element 1682-6) are fabricated on PCB 1646. The vertical coupling elements 1682 are electrically connected to conductive segments along the right-hand edge of the capacitive radiating patch 1104 and electrically connected to the primary ground plane 502. Vertical coupling elements 1692 (including vertical coupling element 1692-1 . . . vertical coupling element 1692-6) are fabricated on PCB 1648. The vertical coupling elements 1692 are electrically connected to the primary ground plane 502 and electrically connected to the secondary ground plane 1602.

Similar vertical coupling elements (not shown) are configured along the top edge and the left edge of the capacitive radiating patch 1104. The vertical coupling elements can be conductive segments or generalized RLC elements.

Linear-polarized patch antennas, as described above, can also be configured with a secondary ground plane.

Figures 17A, 17B, 17C:
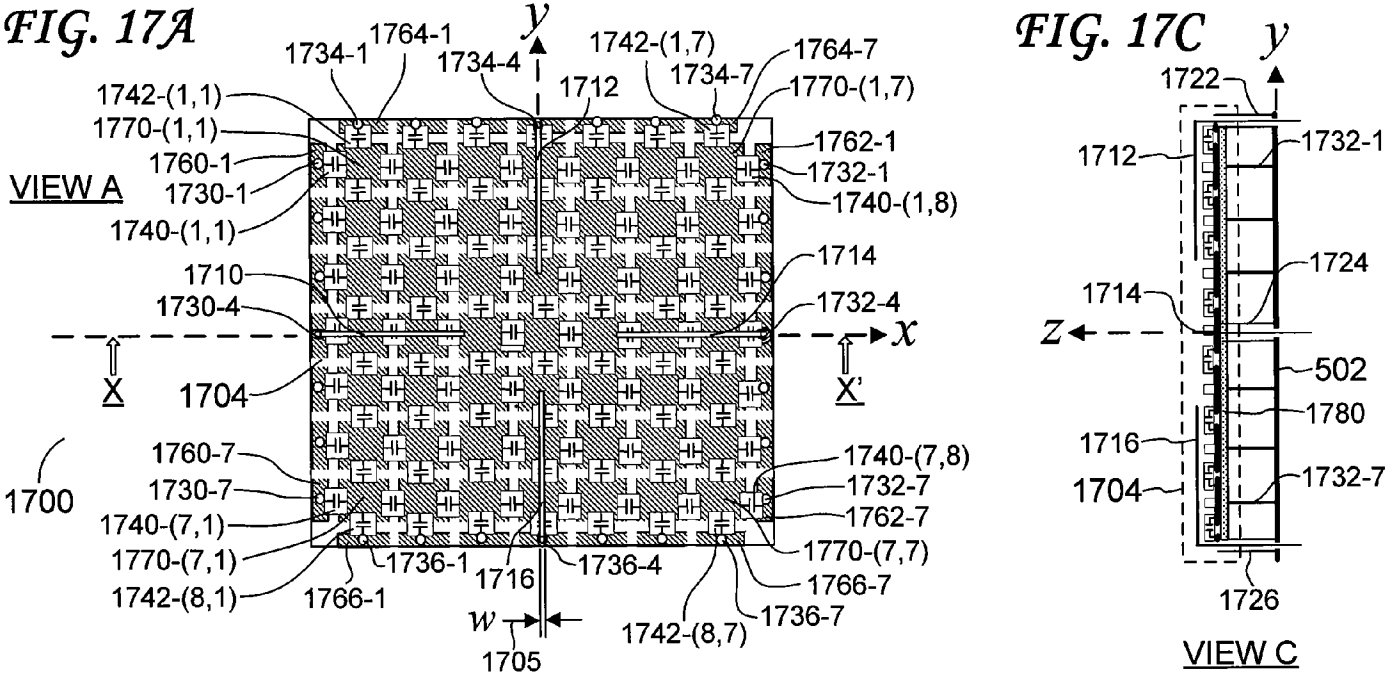
FIG. 17A-FIG. 17C show an embodiment of a circularly-polarized patch antenna with a capacitive radiating patch and exciters configured above the capacitive radiating patch.

FIG. 17A-FIG. 17C show View A-View C, respectively, of a circularly-polarized patch antenna 1700, according to an embodiment of the invention. The patch antenna 1700 includes a ground plane 502 and a capacitive radiating patch 1704.

In the embodiment shown, there are five groups of conductive segments on the capacitive radiating patch 1704. The conductive segment group 1760 (which includes conductive segment 1760-1 . . . conductive segment 1760-7) is configured as a column along the left-hand edge of PCB 1780. The conductive segment group 1762 (which includes conductive segment 1762-1 . . . conductive segment 1762-7) is configured as a column along the right-hand edge of PCB 1780. The conductive segment group 1764 (which includes conductive segment 1764-1 . . . conductive segment 1764-7) is configured as a row along the top edge of PCB 1780. The conductive segment group 1766 (which includes conductive segment 1766-1 . . . conductive segment 1766-6) is configured as a row along the bottom edge of PCB 1780. The conductive segment group 1770 is configured as a two-dimensional matrix between the edges of the PCB 1780. The conductive segments in conductive segment group 1770 are indexed by (row, column) numbers, ranging from conductive segment 1770-(1,1) . . . conductive segment 1770-(7,7).

Adjacent conductive segments are bridged by capacitors 1740 along the x-axis. The individual capacitors are indexed by (row, column), ranging from capacitor 1740-(1,1) . . . capacitor 1740-(7,8). For example, the conductive segment 1760-1 and the conductive segment 1770-(1,1) are bridged by the capacitor 1740-(1,1); and the conductive segment 1770-(7,7) and the conductive segment 1762-7 are bridged by the capacitor 1740-(7,8).

Adjacent conductive segments are bridged by capacitors 1742 along the y-axis. The individual capacitors are indexed by (row, column), ranging from capacitor 1742-(1,1) . . . capacitor 1742-(8,7). For example, the conductive segment 1764-1 and the conductive segment 1770-(1,1) are bridged by the capacitor 1742-(1,1); and the conductive segment 1770-(7,7) and the conductive segment 1766-7 are bridged by the capacitor 1742-(8,7).

Vertical coupling elements are configured along all four edges of the capacitive radiating patch 1704. Vertical coupling elements 1730 are configured along the left-hand edge; the individual vertical coupling elements are denoted vertical coupling element 1730-1 . . . vertical coupling element 1730-7. Vertical coupling elements 1732 are configured along the right-hand edge; the individual vertical coupling elements are denoted vertical coupling element 1732-1 . . . vertical coupling element 1730-7. Vertical coupling elements 1734 are configured along the top edge; the individual vertical coupling elements are denoted vertical coupling element 1734-1 . . . vertical coupling element 1734-7. Vertical coupling elements 1736 are configured along the bottom edge; the individual vertical coupling elements are denoted vertical coupling element 1736-1 . . . vertical coupling element 1736-7.

In the embodiment shown in FIG. 17A-FIG. 17C, most of the vertical coupling elements are configured as a set of conductive pins (exceptions are discussed below). For each pin, one end is electrically connected to a conductive segment on the capacitive radiating patch 1704, and the other end is electrically connected to the ground plane 502. For example, the vertical coupling element 1730-1 is electrically connected to the conductive segment 1760-1 and electrically connected to the ground plane 502; and the vertical coupling element 1732-7 is electrically connected to the conductive segment 1762-7 and electrically connected to the ground plane 502. For electrical connection to a conductive segment, the pin can be inserted through a via hole in PCB 1780 and soldered onto the conductive segment.

In the patch antenna 1700, there are four exciters (denoted exciter 1710, exciter 1712, exciter 1714, and exciter 1716) configured above the capacitive radiator patch 1704. Each exciter is a conductor with a length l 1703 and a lateral dimension w 1705. The distance of an exciter above the capacitive radiating patch 1704 is denoted s 1701. The parameters l, w, and s have user-defined values. In an embodiment, the length l is approximately (0.10-0.25)λ, the width w is approximately (0.001-0.1)λ, and the distance s is approximately (0.001-0.02)λ, where λ is the wavelength of the received electromagnetic radiation. Exciter 1710, exciter 1712, exciter 1714, and exciter 1716 are oriented ninety-degrees apart. They are phase-shifted by 0, 90, 180, and 270 deg, respectively.

In an embodiment, an exciter is fed by the center conductor of a coaxial cable. The exciter 1710 is fed by the center conductor of the coaxial cable 1720 (FIG. 17B). The center conductor passes through an opening in the ground plane 502 and is electrically connected to a power splitter. The shield of the coaxial cable 1720 serves as a vertical coupling element. One end is electrically connected to a conductive segment on the capacitive radiating patch 1704; the other end is electrically connected to the ground plane 502.

The other exciters are similarly configured. The exciter 1714 is fed by the center conductor of the coaxial cable 1724 (FIG. 17B). The exciter 1712 is fed by the center conductor of the coaxial cable 1722 (FIG. 17C), and the exciter 1716 is fed by the center conductor of the coaxial cable 1726 (FIG. 17C).

Figure 18:
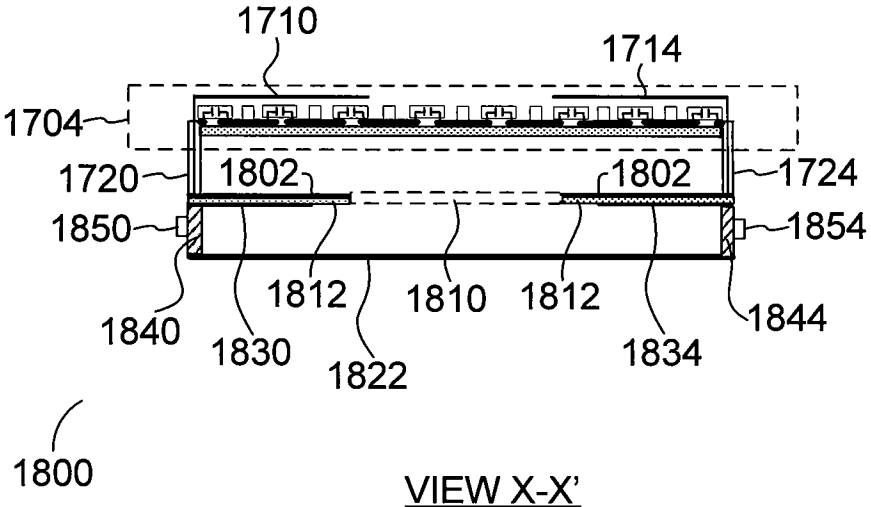
FIG. 18 shows an embodiment of a circularly-polarized patch antenna with a capacitive radiating patch, a secondary ground plane, and a feed patch.

FIG. 18 shows a cross-sectional view (View X-X') of a circularly-polarized patch antenna 1800, according to an embodiment of the invention. The patch antenna 1800 includes a capacitive radiating patch 1704 (as described above), a primary ground plane 1802, and a secondary ground plane 1822. The primary ground plane 1802 is fabricated from a metal film deposited on the top side of the PCB 1812. The primary ground plane 1802 has a pair of orthogonal slots (similar to those shown in FIG. 13B); FIG. 18 shows one of the slots, denoted slot 1810. The orthogonal slots serve as passive radiators.

Vertical coupling elements electrically connect conductive segments on the capacitive radiating patch 1704 with the primary ground plane 1802 (similar to the vertical coupling elements electrically connecting conductive segments on the capacitive radiating patch 1704 with the ground plane 502 in FIG. 17A-FIG. 17C).

The exciter 1710 is fed by the center conductor of the coaxial cable 1720. The center conductor passes through an opening in the primary ground plane 1802 and a via hole in the PCB 1812 and is electrically connected to a conductive strip 1830 (such as a microstrip line) deposited on the underside of the PCB 1812. The conductive strip 1830 is electrically connected to a power splitter. The shield of the coaxial cable 1720 serves as a vertical coupling element. One end is electrically connected to a conductive segment on the capacitive radiating patch 1704; the other end is electrically connected to the primary ground plane 1802.

The other exciters (exciter 1714, exciter 1712, and exciter 1716) are similarly configured. Also shown in FIG. 18 is exciter 1714, which is fed by the center conductor of the coaxial cable 1724. The center conductor passes through an opening in the primary ground plane 1802 and a via hole in the PCB 1812 and is electrically connected to a conductive strip 1834 (such as a microstrip line) deposited on the underside of the PCB 1812. The conductive strip 1834 is electrically connected to a power splitter. The shield of the coaxial cable 1724 serves as a vertical coupling element. One end is electrically connected to a conductive segment on the capacitive radiating patch 1704; the other end is electrically connected to the primary ground plane 1802.

Vertical coupling elements can also be configured between the primary ground plane 1802 and the secondary ground plane 1822. For example, the vertical coupling element 1850 is fabricated on the PCB 1840, and the vertical coupling element 1854 is fabricated on the PCB 1844.

Figure 19:
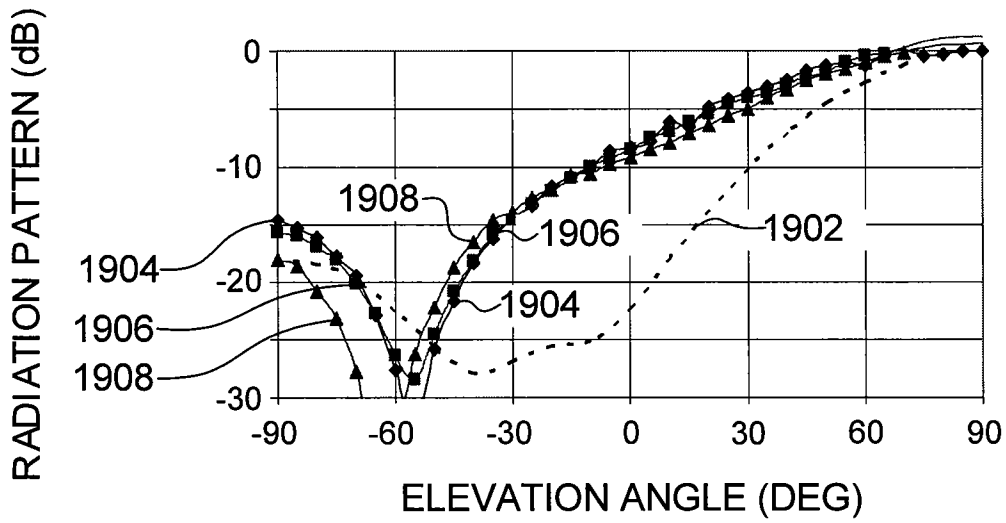
FIG. 19 shows plots of radiation pattern as a function of elevation angle.

FIG. 19 compares the radiation patterns (in the E plane) as a function of elevation angle for a standard patch antenna and for a patch antenna with a capacitive radiating patch. Both patch antennas have an air dielectric. The lateral dimension of the radiating patch on both antennas is 100 mm. Plot 1902 shows the results for the standard patch antenna at an operating frequency of 1230 MHz. Plot 1904, plot 1906, and plot 1908 show the results for the patch antenna with a capacitive radiating patch at an operating frequency of 1210 MHz, 1300 MHz, and 1400 MHz, respectively. For the standard patch antenna, the radiation pattern drops 22 dB as the elevation angle is varied from the zenith (elevation angle=90 deg) to the horizon (elevation angle=0 deg). In contrast, for the patch antenna with a capacitive radiating patch, the radiation pattern drops only 8 dB.

Figure 20:
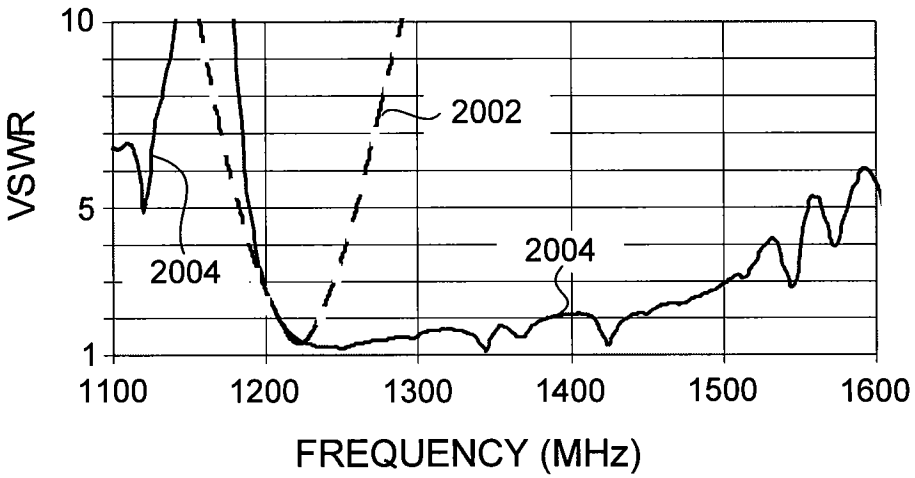
FIG. 20 shows plots of voltage standing wave ratio as a function of frequency.

FIG. 20 compares the voltage standing wave ratio (VSWR) as a function of frequency for a standard patch antenna and a patch antenna with a capacitive radiating patch. Both patch antennas have an air dielectric. The lateral dimension of the radiating patch on both antennas is 5 mm. The patch antenna with a capacitive radiating patch has a 2.2 pF tuning capacitor coupled to the feed (center conductor of a coaxial cable). Plot 2002 shows the results for the standard patch antenna. Plot 2004 shows the results for the patch antenna with a capacitive radiating patch. At a frequency of 1300 MHz, the bandwidth of the patch antenna with a capacitive radiating patch is ~15%. At a frequency of 1230 MHz, the bandwidth of the standard patch antenna is much narrower, only ~4%.

Figure 21B:
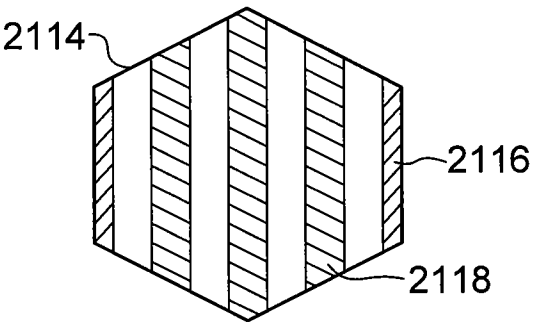
FIG. 21A-FIG. 21C show embodiments of capacitive radiating patches and conductive segments with various geometries.
Figure 21A:
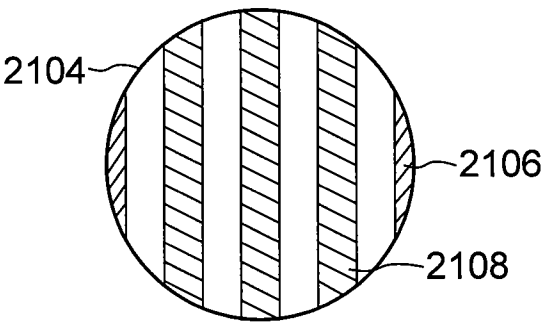
Figure 21C:
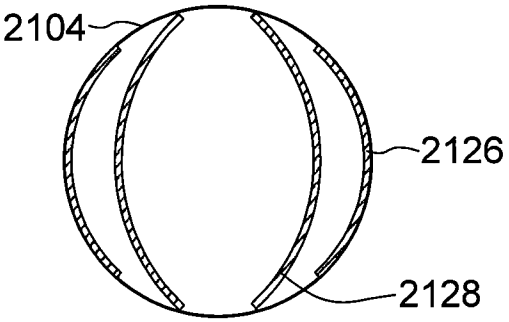

In the embodiments described above, the capacitive radiating patch and the ground plane were shown with rectangular geometries. In general, the ground plane and the capacitive radiating patch can have user-specified geometries, including polygonal, circular, and elliptical. FIG. 21A and FIG. 21C show a capacitive radiating patch 2104 with a circular geometry. FIG. 21B shows a capacitive radiating patch 2114 with a hexagonal geometry.

In general, the geometry of the ground plane can be different from the geometry of the capacitive radiating patch. In general, the size of the ground plane can be larger than or equal to the size of the capacitive radiating patch. In general, the ground plane and the capacitive radiating patch are substantially parallel to within a user-specified tolerance (depending on parameters such as specifications for antenna performance and available manufacturing tolerances). In general, the vertical coupling elements are substantially orthogonal to the ground plane and to the capacitive radiating patch to within user-specified tolerances (depending on parameters such as specifications for antenna performance and available manufacturing tolerances).

In the embodiments described above, the conductive segments (including conductive strips) were shown with rectangular geometries. In general, the conductive segments can have user-defined geometries. (Note: To simplify the figures, the capacitors are not shown in FIG. 21A-FIG. 21C.) In FIG. 21A, the conductive segment 2106 is a representative conductive segment along the periphery of the capacitive radiating patch 2104, and the conductive segment 2108 is a representative conductive segment within the interior of capacitive radiating patch 2104.

In FIG. 21B, the conductive segment 2116 is a representative conductive segment along the periphery of the capacitive radiating patch 2114, and the conductive segment 2118 is a representative conductive segment within the interior of the capacitive radiating patch 2114. In general, the width of a conductive segment does not need to be constant; the width of a conductive segment can vary along its length.

In FIG. 21C, the conductive segment 2126 is a representative conductive segment along the periphery of the capacitive radiating patch 2104, and the conductive segment 2128 is a representative conductive segment within the interior of the capacitive radiating patch 2128. Note that the conductive segment 2126 and the conductive segment 2128 are curvilinear.

Figure 22A:
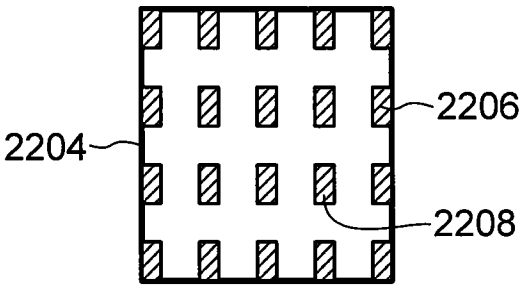
FIG. 22A-FIG. 22D show embodiments of capacitive radiating patches and conductive segments with various geometries.
Figure 22B:
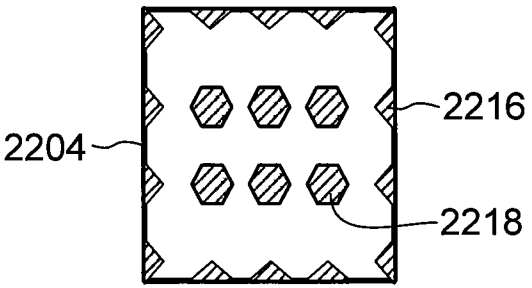
Figure 22C:
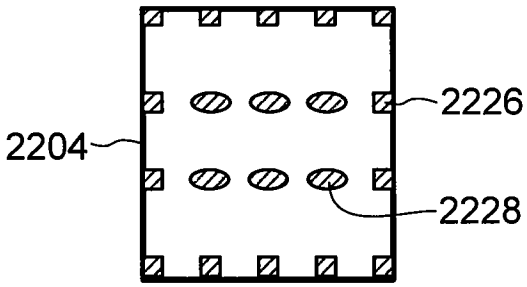

FIG. 22A-FIG. 22D show additional examples of the geometries of conductive segments. (Note: To simplify the figures, the capacitors are not shown in FIG. 21A-FIG. 21D.) In FIG. 22A-FIG. 22C, the capacitive radiating patch 2204 has a rectangular geometry. In FIG. 22A, the representative conductive segment 2206 along the periphery of the capacitive radiating patch 2204 has a rectangular geometry, and the representative conductive segment 2208 within the interior of the capacitive radiating patch 2204 has a rectangular geometry.

In FIG. 22B, the representative conductive segment 2216 along the periphery of the capacitive radiating patch 2204 has a triangular geometry, and the representative conductive segment 2218 within the interior of the capacitive radiating patch 2204 has a hexagonal geometry.

In FIG. 22C, the representative conductive segment 2226 along the periphery of the capacitive radiating patch 2204 has a square geometry, and the representative conductive segment 2228 within the interior of the capacitive radiating patch 2204 has an elliptical geometry.

Figure 22D:
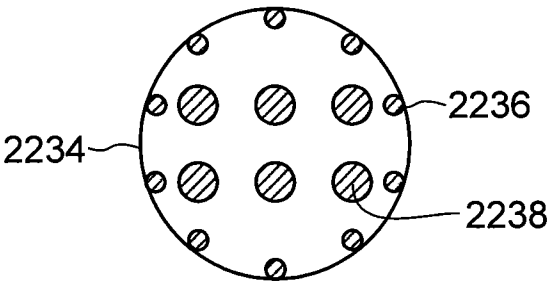

In FIG. 22D, the capacitive radiating patch 2234 has a circular geometry. The representative conductive segment 2236 along the periphery of the capacitive radiating patch 2234 has a circular geometry, and the representative conductive segment 2238 within the interior of the capacitive radiating patch 2234 has a circular geometry.

In general, the dimensions of each conductive segment can be independently varied, and the spacing between adjacent conductive segments can be independently varied.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A patch antenna comprising:

a radiating patch comprising:

a first conductive strip disposed along a first peripheral region of the radiating patch;

a second conductive strip disposed along a second peripheral region of the radiating patch;

at least one conductive strip disposed between the first conductive strip and the second conductive strip; and for every two adjacent conductive strips:

at least one capacitor electrically connected to each of the two adjacent conductive strips;

a ground plane separated from the radiating patch by a dielectric medium, the ground plane comprising a slot configured to receive or transmit electromagnetic signals, wherein the slot is operatively coupled to and fed by an excitation source such that an electric field vector having a constant magnitude is oriented parallel to a surface of the ground plane along a horizontal axis;

at least one vertical coupling element electrically connected to the first conductive strip and to the ground plane; and at least one vertical coupling element electrically connected to the second conductive strip and to the ground plane.

2. The patch antenna of claim 1, wherein the patch antenna is configured to operate in a linear-polarization mode.

3. The patch antenna of claim 1, wherein the dielectric medium comprises air.

4. The patch antenna of claim 1, wherein the dielectric medium comprises a dielectric solid.

5. The patch antenna of claim 1, wherein:

the radiating patch is substantially parallel to the ground plane; and each of the at least one vertical coupling element is substantially orthogonal to the radiating patch and to the ground plane.

6. The patch antenna of claim 1, wherein the at least one vertical coupling element comprises a conductor.

7. The patch antenna of claim 1, wherein the at least one vertical coupling element comprises at least one electrical component selected from the group consisting of:

a resistor;

an inductor; and a capacitor.

8. The patch antenna of claim 1, wherein the ground plane is a first ground plane and the dielectric medium is a first dielectric medium, further comprising:

a second ground plane separated from the first ground plane by a second dielectric medium; and at least one vertical coupling element electrically connected to the first ground plane and to the second ground plane.

9. The patch antenna of claim 8, wherein the second dielectric medium comprises air.

10. The patch antenna of claim 8, wherein the second dielectric medium comprises a dielectric solid.

11. The patch antenna of claim 8, wherein a spacing between the first ground plane and the second ground plane is approximately $(0.02\text{-}0.1)\lambda_0$, wherein $\lambda_0$ is a wavelength in free space of an electromagnetic signal that the patch antenna is configured to receive.

12. A patch antenna comprising:

a radiating patch comprising:

a first plurality of conductive segments disposed along a first peripheral region of the radiating patch;

a second plurality of conductive segments disposed along a second peripheral region of the radiating patch;

a third plurality of conductive segments disposed between the first plurality of conductive segments and the second plurality of conductive segments;

wherein the first plurality of conductive segments, the second plurality of conductive segments, and the third plurality of conductive segments are configured substantially in an array comprising a plurality of rows and a plurality of columns, wherein each row in the plurality of rows extends substantially from the first peripheral region to the second peripheral region; and for each row of conductive segments:

at least one capacitor electrically connected to every two adjacent conductive segments;

a ground plane separated from the radiating patch by a dielectric medium, the ground plane comprising a slot configured to receive or transmit electromagnetic signals, wherein the slot is operatively coupled to and fed by an excitation source such that an electric field vector having a constant magnitude is oriented parallel to a surface of the ground plane along a horizontal axis; and for each conductive segment in the first plurality of conductive segments and in the second plurality of conductive segments:

a vertical coupling element electrically connected to the conductive segment and to the ground plane.

13. The patch antenna of claim 12, wherein the patch antenna is configured to operate in a linear-polarization mode.

14. The patch antenna of claim 12, wherein the dielectric medium comprises air.

15. The patch antenna of claim 12, wherein the dielectric medium comprises a dielectric solid.

16. The patch antenna of claim 12, wherein:

the radiating patch is substantially parallel to the ground plane; and the at least one vertical coupling element is substantially orthogonal to the radiating patch and to the ground plane.

17. The patch antenna of claim 12, wherein the at least one vertical coupling element comprises a conductor.

18. The patch antenna of claim 12, wherein the at least one vertical coupling element comprises at least one electrical component selected from the group consisting of:

a resistor;

an inductor; and a capacitor.

19. The patch antenna of claim 12, wherein the ground plane is a first ground plane and the dielectric medium is a first dielectric medium, further comprising:

a second ground plane separated from the first ground plane by a second dielectric medium; and at least one vertical coupling element electrically connected to the first ground plane and to the second ground plane.

20. The patch antenna of claim 19, wherein the second dielectric medium comprises air.

21. The patch antenna of claim 19, wherein the second dielectric medium comprises a dielectric solid.

22. The patch antenna of claim 19, wherein a spacing between the first ground plane and the second ground plane is approximately $(0.02\text{-}0.1)\lambda_0$, wherein $\lambda_0$ is a wavelength in free space of an electromagnetic signal that the patch antenna is configured to receive.

23. A patch antenna comprising:

a radiating patch comprising:

a first plurality of conductive segments disposed along a first peripheral region of the radiating patch;

a second plurality of conductive segments disposed along a second peripheral region of the radiating patch;

a third plurality of conductive segments disposed along a third peripheral region of the radiating patch;

a fourth plurality of conductive segments disposed along a fourth peripheral region of the radiating patch;

a fifth plurality of conductive segments disposed between the first plurality of conductive segments, the second plurality of conductive segments, the third plurality of conductive segments, and the fourth plurality of conductive segments;

wherein the first plurality of conductive segments, the second plurality of conductive segments, the third plurality of conductive segments, the fourth plurality of conductive segments, and the fifth plurality of conductive segments are configured substantially in an array comprising a plurality of rows and a plurality of columns, wherein each row in the plurality of rows extends substantially from the first peripheral region to the second peripheral region and each column in the plurality of columns extends substantially from the third peripheral region to the fourth peripheral region;

for each row of conductive segments:

at least one capacitor electrically connected to every two adjacent conductive segments; and for each column of conductive segments:

at least one capacitor electrically connected to every two adjacent conductive segments;

a ground plane separated from the radiating patch by a dielectric medium, the ground plane comprising:

a first slot configured to receive or transmit first electromagnetic signals; and a second slot substantially orthogonal to the first slot, the second slot configured to receive or transmit second electromagnetic signals, wherein a first slot is operatively coupled to a first excitation source and the second slot is operatively coupled to a second excitation source, the first slot and the second slot being respectively fed by the first excitation source and the second excitation source to excite an electric field vector as a sum of two orthogonal linear polarizations such that the electric field vector has a constant magnitude and is oriented parallel to a surface of the ground plane along a horizontal axis; and for each conductive segment in the first plurality of conductive segments, the second plurality of conductive segments, the third plurality of conductive segments, and the fourth plurality of conductive segments:

a vertical coupling element electrically connected to the conductive segment and to the ground plane.

24. The patch antenna of claim 23, wherein the patch antenna is configured to operate in a circular-polarization mode.

25. The patch antenna of claim 23, wherein the dielectric medium comprises air.

26. The patch antenna of claim 23, wherein the dielectric medium comprises a dielectric solid.

27. The patch antenna of claim 23, wherein:

the radiating patch is substantially parallel to the ground plane; and the at least one vertical coupling element is substantially orthogonal to the radiating patch and to the ground plane.

28. The patch antenna of claim 23, wherein the at least one vertical coupling element comprises a conductor.

29. The patch antenna of claim 23, wherein the at least one vertical coupling element comprises at least one electrical component selected from the group consisting of:

a resistor;

an inductor; and a capacitor.

30. The patch antenna of claim 23, wherein the ground plane is a first ground plane and the dielectric medium is a first dielectric medium, further comprising:

a second ground plane separated from the first ground plane by a second dielectric medium; and at least one vertical coupling element electrically connected to the first ground plane and to the second ground plane.

31. The patch antenna of claim 30, wherein the second dielectric medium comprises air.

32. The patch antenna of claim 30, wherein the second dielectric medium comprises a dielectric solid.

33. The patch antenna of claim 30, wherein a spacing between the first ground plane and the second ground plane is approximately $(0.02\text{-}0.1)\lambda_0$, wherein $\lambda_0$ is a wavelength in free space of an electromagnetic signal that the patch antenna is configured to receive.

34. The patch antenna of claim 23, wherein the phase difference between the first excitation source and the second excitation source is 90 degrees.

* * * * *